US007261168B2

(12) United States Patent
McGregor et al.

(10) Patent No.: US 7,261,168 B2
(45) Date of Patent: Aug. 28, 2007

(54) METHODS AND APPARATUS FOR USING FORMATION PROPERTY DATA

(75) Inventors: Malcolm Douglas McGregor, The Woodlands, TX (US); Glenn C. Gray, Austin, TX (US); James E. Stone, Porter, TX (US); Svetozar Simeonov, Houston, TX (US); Gregory N. Gilbert, Sugar Land, TX (US); Mark A. Proett, Missouri City, TX (US); James M. Fogal, Houston, TX (US); William Edward Hendricks, Kingwood, TX (US); Christopher Anthony Maranuk, Houston, TX (US); Jean Michel Beique, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 125 days.

(21) Appl. No.: 11/134,896

(22) Filed: May 23, 2005

(65) Prior Publication Data

US 2005/0257960 A1 Nov. 24, 2005

Related U.S. Application Data

(60) Provisional application No. 60/573,286, filed on May 21, 2004.

(51) Int. Cl.
*E21B 44/00* (2006.01)

(52) U.S. Cl. ..... 175/50; 175/48; 166/250.07; 166/100; 73/152.03; 73/152.19; 73/152.22

(58) Field of Classification Search ..... 175/48, 175/50; 166/250.07, 100; 73/152.03, 152.19, 73/152.22

See application file for complete search history.

(56) References Cited

U.S. PATENT DOCUMENTS 3,173,485 A 3/1965 Bretzke, Jr.

(Continued)

FOREIGN PATENT DOCUMENTS

EP 0697501 A2 2/1996

(Continued)

OTHER PUBLICATIONS

Joel L. Hebert; "A Method for Planning and Performing a Pressure Survey to Achieve Desired Accuracy of Pressure Gradient"; 2002 ASME Engineering Technology Conference on Energy; Feb. 4-5, 2002; pp. 1-8; ETCE 2002; American Society of Mechanical Engineers; Houston, Texas, U.S.A.

(Continued)

*Primary Examiner*—Jennifer H. Gay
*Assistant Examiner*—Nicole A Coy
(74) *Attorney, Agent, or Firm*—Conley Rose P.C.

(57) ABSTRACT

This application relates to various methods and apparatus for rapidly obtaining accurate formation property data from a drilled earthen borehole. Once obtained, the formation property data, including formation fluid pressure, may be corrected, calibrated and supplemented using various other data and techniques disclosed herein. Furthermore, the formation property data may be used for numerous other purposes. For example, the data may be used to correct or supplement other information gathered from the borehole; it may be used to supplement formation images or models; or, it may be used to adjust a drilling or producing parameter. Various other uses of accurately and quickly obtained formation property data are also disclosed.

22 Claims, 11 Drawing Sheets

U.S. PATENT DOCUMENTS 3,338,307 A 8/1967 Redwine
3,356,137 A 12/1967 Raugust
3,530,933 A 9/1970 Whitten
3,565,169 A 2/1971 Bell
3,811,321 A 5/1974 Urbanosky
3,813,936 A 6/1974 Urbanosky et al.
3,858,445 A 1/1975 Urbanosky
3,859,850 A 1/1975 Whitten et al.
3,859,851 A 1/1975 Urbanosky
3,864,970 A 2/1975 Bell
3,924,463 A 12/1975 Urbanosky
3,952,588 A 4/1976 Whitten
4,210,018 A 7/1980 Brieger
4,246,782 A 1/1981 Hallmark
4,248,081 A 2/1981 Hallmark
4,270,385 A 6/1981 Hallmark
4,282,750 A 8/1981 Prats et al.
4,287,946 A 9/1981 Brieger
4,292,842 A 10/1981 Hallmark
4,339,948 A 7/1982 Hallmark
4,375,164 A 3/1983 Dodge et al.
4,416,152 A 11/1983 Wilson
4,434,653 A 3/1984 Montgomery
4,507,957 A 4/1985 Montgomery et al.
4,513,612 A 4/1985 Shalek
4,593,560 A 6/1986 Purfurst
4,671,322 A 6/1987 Purfurst
4,712,613 A 12/1987 Nieuwstad
4,720,996 A 1/1988 Marsden et al.
4,742,459 A 5/1988 Lasseter
4,745,802 A 5/1988 Purfurst
4,782,695 A 11/1988 Glotin et al.
4,833,914 A 5/1989 Rasmus
4,843,878 A 7/1989 Purfurst et al.
4,845,982 A 7/1989 Gilbert
4,860,580 A 8/1989 DuRocher
4,860,581 A 8/1989 Zimmerman et al.
4,862,967 A 9/1989 Harris
4,879,900 A 11/1989 Gilbert
4,884,439 A 12/1989 Baird
4,890,487 A 1/1990 Dussan V. et al.
4,893,505 A 1/1990 Marsden et al.
4,936,139 A 6/1990 Zimmerman et al.
4,941,350 A 7/1990 Schneider
4,949,575 A 8/1990 Rasmus
4,951,749 A 8/1990 Carroll
4,962,665 A 10/1990 Savage et al.
4,994,671 A 2/1991 Safinya et al.
5,056,595 A 10/1991 Desbrandes
5,095,745 A 3/1992 Desbrandes
5,148,705 A 9/1992 Desbrandes
5,166,747 A 11/1992 Schroeder et al.
5,167,149 A 12/1992 Mullins et al.
5,184,508 A 2/1993 Desbrandes
5,201,220 A 4/1993 Mullins et al.
5,207,104 A 5/1993 Enderlin
5,230,244 A 7/1993 Gilbert
5,233,866 A 8/1993 Desbrandes
5,247,830 A 9/1993 Goode
5,265,015 A 11/1993 Auzerais et al.
5,269,180 A 12/1993 Dave et al.
5,279,153 A 1/1994 Dussan V. et al.
5,303,582 A 4/1994 Miska
5,303,775 A 4/1994 Michaels et al.
5,329,811 A 7/1994 Schultz et al.
5,335,542 A 8/1994 Ramakrishnan et al.
5,353,637 A 10/1994 Plumb et al.
5,377,755 A 1/1995 Michaels et al.
5,473,939 A 12/1995 Leder et al.
5,517,854 A 5/1996 Plumb et al.
5,549,159 A 8/1996 Shwe et al.
5,549,162 A 8/1996 Moody et al.
5,587,525 A 12/1996 Shwe et al.
5,602,334 A 2/1997 Proett et al.
5,622,223 A 4/1997 Vasquez
5,635,631 A 6/1997 Yesudas et al.
5,644,076 A 7/1997 Proett et al.
5,663,559 A 9/1997 Auzerais et al.
5,672,819 A 9/1997 Chin et al.
5,703,286 A 12/1997 Proett et al.
5,708,204 A 1/1998 Kasap
5,741,962 A 4/1998 Birchak et al.
5,770,798 A 6/1998 Georgi et al.
5,789,669 A 8/1998 Flaum
5,803,186 A 9/1998 Berger et al.
5,924,499 A * 7/1999 Birchak et al. ..... 175/40
5,934,374 A 8/1999 Hrametz et al.
5,969,241 A 10/1999 Auzerais
6,026,915 A 2/2000 Smith et al.
6,044,325 A * 3/2000 Chakravarthy et al. ..... 702/7
6,047,239 A 4/2000 Berger et al.
6,058,773 A 5/2000 Zimmerman et al.
6,092,416 A 7/2000 Halford et al.
6,109,370 A * 8/2000 Gray ..... 175/61
6,111,409 A 8/2000 Edwards et al.
6,128,949 A 10/2000 Kleinberg
6,157,893 A * 12/2000 Berger et al. ..... 702/9
6,164,126 A 12/2000 Ciglenec et al.
6,178,815 B1 1/2001 Felling et al.
6,223,822 B1 5/2001 Jones
6,230,557 B1 * 5/2001 Ciglenec et al. ..... 73/152.01
6,247,542 B1 6/2001 Kruspe et al.
6,274,865 B1 8/2001 Schroer et al.
6,334,489 B1 1/2002 Shwe et al.
6,343,507 B1 2/2002 Felling et al.
6,350,986 B1 2/2002 Mullins et al.
6,388,251 B1 5/2002 Papanyan
6,415,648 B1 7/2002 Peeters
6,427,530 B1 8/2002 Krueger et al.
6,439,307 B1 8/2002 Reinhardt
6,446,736 B1 9/2002 Kruspe et al.
6,474,152 B1 11/2002 Mullins et al.
6,476,384 B1 11/2002 Mullins et al.
6,478,096 B1 11/2002 Jones et al.
6,513,606 B1 2/2003 Krueger
6,516,898 B1 2/2003 Krueger
6,568,487 B2 5/2003 Meister et al.
RE38,129 E 6/2003 Kleinberg
6,581,455 B1 6/2003 Berger et al.
6,585,045 B2 7/2003 Lee et al.
6,609,568 B2 8/2003 Krueger et al.
6,637,524 B2 10/2003 Kruspe et al.
6,640,908 B2 11/2003 Jones et al.
6,655,458 B2 12/2003 Kurkjian et al.
6,658,930 B2 12/2003 Abbas
6,659,177 B2 12/2003 Bolze et al.
6,668,924 B2 12/2003 Bolze et al.
6,672,386 B2 1/2004 Krueger et al.
6,688,390 B2 2/2004 Bolze et al.
6,719,049 B2 4/2004 Sherwood et al.
6,729,399 B2 5/2004 Follini et al.
6,745,835 B2 6/2004 Fields
6,859,033 B2 * 2/2005 Speier ..... 324/303
2001/0035289 A1 11/2001 Runia
2002/0046835 A1 4/2002 Lee et al.
2002/0084072 A1 7/2002 Bolze et al.
2002/0112854 A1 8/2002 Krueger et al.
2002/0129936 A1 9/2002 Cernosek
2002/0185313 A1 12/2002 Jones et al.
2002/0189338 A1 12/2002 Kruspe et al.
2002/0189339 A1 12/2002 Montalvo et al.
2003/0042021 A1 3/2003 Bolze et al.
2003/0062472 A1 4/2003 Mullins et al.
2003/0066646 A1 4/2003 Shammal et al.

| | | | |
|---|---|---|---|
| 2003/0146022 | A1 | 8/2003 | Krueger |
| 2003/0167834 | A1 | 9/2003 | Weintraub et al. |
| 2003/0214879 | A1 | 11/2003 | Proett et al. |
| 2003/0226663 | A1 | 12/2003 | Krueger et al. |
| 2004/0007058 | A1 | 1/2004 | Rylander et al. |
| 2004/0011525 | A1 | 1/2004 | Jones et al. |
| 2004/0020649 | A1 | 2/2004 | Fields |
| 2004/0026125 | A1 | 2/2004 | Meister et al. |
| 2004/0035199 | A1 | 2/2004 | Meister et al. |
| 2004/0045706 | A1 | 3/2004 | Pop et al. |
| 2004/0050153 | A1 | 3/2004 | Krueger et al. |
| 2004/0050588 | A1 | 3/2004 | Follini et al. |
| 2004/0099443 | A1 | 5/2004 | Meister et al. |
| 2004/0173351 | A1 | 9/2004 | Fox et al. |
| 2004/0230378 | A1 | 11/2004 | Proett et al. |
| 2004/0231408 | A1 | 11/2004 | Shammai |
| 2004/0231841 | A1 | 11/2004 | Niemeyer et al. |
| 2004/0231842 | A1 | 11/2004 | Shammai et al. |

FOREIGN PATENT DOCUMENTS

| | | | |
|---|---|---|---|
| EP | 0994238 | A2 | 4/2000 |
| EP | 0978630 | A2 | 9/2002 |
| GB | 2 304 906 | | 3/1997 |
| WO | WO 01/33044 | A1 | 5/2001 |
| WO | WO 01/33045 | A1 | 5/2001 |
| WO | WO 01/98630 | A1 | 12/2001 |
| WO | WO 02/08570 | A1 | 1/2002 |

OTHER PUBLICATIONS

A.H. Akram et al.; "A Model to Predict Wireline Formation Tester Sample Contamination"; 1998 SPE Annual Technical Conference and Exhibition; Sep. 27-30, 1998; pp. 27-33; SPE 48959; Society of Petroleum Engineers, Inc.; New Orleans, Louisiana, U.S.A.

R. Desbrandes, et al.; "A New Concept in Wireline Formation Testing: Extended Drawdown," 13th CWLS Formation Evaluation Symp.; 1991; Calgary, Canada; pp. 1-25.

Yi Shaoguo et al.; "A New Flow Model of Pressure Response to Wireline Formation Testing"; Journal of Jiaghan Petroleum Institute; vol. 19, No. 3; Sep. 1997; pp. 42-45. (Partial translation attached).

E. Kasap; "A New, Simplified, Unified Technique For The Analysis of Wireline Formation Test Data"; SPWLA 37th Annual Logging Symposium; Jun. 16-19, 1996; pp. 1-13.

Kun Huang; "A Study of Dimensionless Parameters and Formation Rate Analysis Technique for Interpretation of WFT Data"; 1996; pp. 1-147; University of Tulsa; Tulsa, Oklahoma, U.S.A.

Mark A. Proett et al.; "Advanced Permeability and Anistropy Measurements While Testing and Sampling in Real-Time Using A Dual Probe Formation Tester"; 2000 SPE Annual Technical Conference and Exhibition; Oct. 1-4, 2000; pp. 1-15; SPE 62919; Society of Petroleum Engineers, Inc.; Dallas, Texas, U.S.A.

Robert C. Earlougher, Jr.; "Advances In Well Test Analysis"; Society of Petroleum Engineers of AIME; 1997; New York, New York, U.S.A. and Dallas, Texas, U.S.A.

John Michaels et al.; "Advances in Wireline Formation Testing"; SPWLA 36th Annual Logging Symposium; Jun. 26-29, 1995; pp. 1-11.

Amit K. Sakar et al.; "Adverse Effects of Poor Mud Cake Quality: Supercharging and Fluid Sampling Study"; SPE Reservoir Eval. & Eng. 3 (3), Jun. 2000; pp. 256-262; Society of Petroleum Engineers, Inc.; U.S.A.

E. B. Dussan V. et al.; "An Analysis of the Pressure Response of a Single-Probe Formation Tester"; 62nd Annual Technical Conference and Exhibition; Sep. 27-30, 1987: pp. 519-527; SPE 16801; Society of Petroleum Engineers, Inc.; Dallas, Texas, U.S.A.

A.A. Grinko et al.; "Analysis of the Quality of Drilling-In of Producing Formation on the Basis of the Tests During Drilling"; Stroit. Neft. Gaz. Skvazhin Sushe More; Apr.-May 1999; pp. 45-47; Nos. 4-5; ISSN 0130-3872; Russia.

Ekrem Kasa; "Analysis of Wireline Formation Test Data From Gas and Non-Darcy Flow Conditions"; 1998 SPE Permian Basin Oil and Gas Recovery Conference; Mar. 25-27, 1998; pp. 183-189; SPE 39769; Society of Petroleum Engineers, Inc.; Midland, Texas, U.S.A.

T. Zimmerman et al.; "Application of Emerging Wireline Formation Testing Technologies"; Eighth Offshore South East Asia Conference; Dec. 4-7, 1990; pp. 83-95; OSEA 90105; Offshore South East Asia; Singapore.

M. Hooper et al.; "Applications for an LWD Formation Tester"; 1999 SPE European Formation Damage Conference; May 28- Jun. 1, 1999; pp. 1-8; SPE 52794; Society of Petroleum Engineers, Inc.; The Hague, The Netherlands.

Cosan Ayan et al.; "Characterizing Permeability with Formation Testers"; Oilfield Review, Autumn 2001; pp. 2-23.

H. Elshahawi et al.; "Correcting for Wettability and Capillary Pressure Effects on Formation Tester Measurements"; SPWLA 41st Annual Logging Symposium; Jun. 4-7, 2000, pp. 1-14; Society of Petroleum Well Log Analysts; Dallas, Texas, U.S.A.

H. Elshahawi et al.; "Correcting for Wettability and Capillary Pressure Effects on Formation Tester Measurements"; 2000 SPE Annual Technical Conference and Exhibition; Oct. 1-4, 2000; pp. 1-5; SPE 63075; Society of Petrolem Engineers, Inc.; Dallas, Texas, U.S.A.

M. D. Enikeev; "Effect of Shaft Curvature on The Results of Formation Testing During the Drilling of Sloping Wells"; May, 1978; pp. 26-29; pub. No. 004224; All-Union Sci. Res. Inst of Pet & Geophys. Ind.; USSR. (Patial translation attached).

Jaedong Lee et al.; "Enhanced Wireline Formation Test in Low-Permeability Formations: Quality Control Through Formation Rate Analysis"; 2000 SPE Rocky Mountain Regional/Low Permeability Reservoirs Symposium and Exhibition; Mar. 12-15, 2000; pp. 1-4 with Figures 1A-15; SPE 60392; Society of Petroleum Engineers Inc.; Denver, Colorado, U.S.A.

H. Badaam et al.; "Estimation of Formation Properties Using Multiprobe Formation Tester in Layered Reservoirs"; 1998 SPE Annual Technical Conference and Exhibition; Sep. 27-30, 1998; pp. 479-490; SPE 49141; Society of Petroleum Engineers, Inc.; New Orleans, Louisiana, U.S.A.

S.W. Burnie, "Estimation of Reservoir Productivity, Fluid Composition, and Reserves in Sour Gas Formations Using the MDT (Modular Formation Dynamics Tester) Tool and a Comparison with the Completed Well Performance"; 1st CSPG/CWLS Exploration, Evaluation & Exploitation Joint Symposium; May 28-31, 1995; 1 p (Abstract Only); Calgary, Canada.

G. D. Sukhonosov; "Evaluation of Permeability Change Around The Well-Bore Area From Data Obtained With Formation Testers"; Neft Khoz; Oct. 1970; pp. 22-26; No. 10; Russia.

I. Gaz et al.; "Exploring New Methodologies To Acquire DST Type Data"; 1997 Offshore Mediterranean Conference and Exhibition; Mar. 19-21, 1997; pp. 587-592; Ravenna, Italy.

R. Desbrandes et al.; "Field Applications of Wireline Formation Testers in Low-Permeability Gas Reservoirs"; 1991 SPE Gas Technology Symposium; Jan. 23-25, 1991; pp. 223-236; SPE 21502; Society of Petroleum Engineers, Inc.; Houston, Texas, U.S.A.

Long Haitao; "Follow-Up Monitoring and Evaluation of the Formation Pressure in the Process of Drilling"; Natur. Gas Ind., vol. 20, No. 4, pp. 33-36; Jul. 25, 2000. (Partial translation attached).

M. Meister et al.; "Formation Pressure Testing During Drilling: Challenges and Benefits"; SPE Annual Technical Conference and Exhibition; Oct. 5-8, 2003: pp. 1-8; SPE 84088; Society of Petroleum Engineers, Inc.; Denver, CO, U.S.A.

Mark Proett et al.; "Formation Pressure Testing In The Dynamic Drilling Environment"; 2004 IADC/SPE Drilling Conference; Mar. 2-4, 2004; pp. 1-11; IADC/SPE 87090; Society of Petroleum Engineers, Inc.; Dallas, Texas, U.S.A.

C. Frimann-Dahl et al.; "Formation Testers vs DST—The Cost Effective Use of Transient Analysis to Get Reservoir Parameters"; 1998 SPE Annual Technical Conference; Sep. 27-30, 1998; pp. 1-14; SPE 48962; Society of Petroleum Engineers, Inc.; New Orleans, Louisiana, U.S.A.

P.S. Varlamov et al.; "Formation Testing During Deep Well Drilling"; 1983; pp. 118-124; No. 39; Russia. (Partial translation attached).

Peter A. Goode et al.; "Influence of an Invaded Zone on a Multiprobe Formation Tester"; SPE Formation Evaluation, Mar. 1996; pp. 31-40.
Alastair Crombie et al.; "Innovations in Wireline Fluid Sampling"; pp. 26-41; Oilfield Review, Autumn 1998.
R. Desbrandes; "Invasion Diameter and Supercharging in Time-Lapse MWD/LWD Logging"; Proceedings, Measurement While Drilling Symposium; Feb. 26-27, 1990; pp. 115-135; Louisiana State University; Baton Rouge, Louisiana, U.S.A.
Mark A. Proett et al.; "Low Permeability Interpretation Using a New Wireline Formation Tester 'Tight Zone' Pressure Transient Analysis"; 1994 SPWLA 35th Annual Logging Symposium; Jun. 19-22, 1994; pp. 1-25.
R. Desbrandes et al; "Measurement While Drilling"; Studies in Abnormal Pressures. Developments in Petroleum Science, 38; 1994; pp. 251-279; Elsevier Science B.V.
Mark A. Proett et al.; "Multiple Factors That Influence Wireline Formation Tester Pressure Measurements and Fluid Contact Estimates"; 2001 SPE Annual Technical Conference and Exhibition; Sep. 30-Oct. 3, 2001; pp. 1-16; SPE 71566; Society of Petroleum Engineers, Inc.; New Orleans, Louisiana, U.S.A.
Mark A. Proett et al.; "New Dual-Probe Wireline Formation Testing and Sampling Tool Enables Real-Time Permeability and Anistropy Measurements"; 2000 SPE Permian Basin Oil and Gas Recovery Conference; Mar. 21-23, 2000; pp. 1-16; SPE 59701; Society of Petroleum Engineers, Inc.; Midland, Texas, U.S.A.
Mark A. Proett et al.; "New Exact Spherical Flow Solution With Storage and Skin For Early-Time Interpretation With Applications to Wireline Formation and Early-Evaluation Drillstem Testing"; 1998 SPE Annual Technical Conference and Exhibition; Sep. 27-30, 1998; pp. 463-478; SPE 49140; Society of Petroleum Engineers, Inc.; New Orleans, Louisiana, U.S.A.
Mark A. Proett et al.; "New Exact Spherical Flow Solution With Storage For Early-Time Interpretation With Applications to Early-Evaluation Drillstem Testing and Wireline Formation Testing"; 1998 SPE Permian Basin Oil and Gas Recovery Conference; Mar. 25-27, 1998; pp. 167-181; SPE 39768; Society of Petroleum Engineers, Inc.; Midland, Texas, U.S.A.
Rob Badry et al; "New Wireline Formation Tester Techniques and Applications"; 1993 SPWLA Annual Symposium; Jun. 13-16, 1993; pp. 1-15; Calgary, Alberta, Canada.
Mark A. Proett et al.; "New Wireline Formation Testing Tool With Advanced Sampling Technology"; 1999 SPE Annual Technical Conference and Exhibition; Oct. 3-6, 1999; pp. 1-16; SPE 56711; Society of Petroleum Engineers, Inc.; Houston, Texas, U.S.A.
A. F. Shakirov et al.; "On The Regimes of Formation Testing In Wells"; Neft Khoz; Dec. 1973; pp. 14-17; No. 12; Russia.
K. Zainun et al.; "Optimized Exploration Resource Evaluation Using the MDT Tool"; 1995 SPE Asia Pacific Oil and Gas Conference; Mar. 20-22, 1995; pp. 177-194; SPE 29270; Society of Petroleum Engineers, Inc.; Kuala Lumpur, Malaysia.
Jaedong Lee et al.; "Pressure Test Analysis of Gas Bearing Formations"; 1998 SPWLA 39th Annual Logging Symposium ; May 26-29, 1998; pp. 1-9.
Mark A. Proett et al.; "Real Time Pressure Transient Analysis Methods Applied to Wireline Formation Test Data"; 69th Annual Technical Conference and Exhibition of the Society of Petroleum Engineers; Sep. 25-28, 1994; pp. 1-16; SPE 28449; Society of Petroleum Engineers, Inc.; New Orleans, Louisiana, U.S.A.
V. D. Banchenko et al.; "Results of Using Strata Testers Mounted on Tubes Lowered Into Boreholes in the Southern Mangyshlak Field"; 1982; pp. 28-29; No. 8; ISSN- 0521-8136; Burenie; Russia (Partial translation attached).
E. Kasap et al.; "Robust and Simple Graphical Solution For Wireline Formation Tests: Combined Drawdown and Buildup Analyses"; 1996 SPE Annual Technical Conference and Exhibition; Oct. 6-9, 1996; pp. 343-357; SPE 36525; Society of Petroleum Engineers, Inc.; Denver, Colorado, U.S.A.
S. Haddad et al; "So What Is The Reservoir Permeability?"; 2000 SPE Annual Technical Conference and Exhibition; Oct. 1-4, 2000; pp. 1-13; SPE 63138; Society of Petroleum Engineers, Inc.; Dallas, Texas, U.S.A.
P. Cooke-Yarborough; "Some 'Quick-Look' and Wellsite Applications of Wireline Formation Testing Tools With Emphasis on Permeability Indicators as an Aid to Choosing Net Pay Discriminations"; Proceedings Indonesian Petroleum Association; Thirteenth Annual Convention; May 1994; pp. 1-16.
P. S. Lapshin et al.; "Study of the Effect of Variable Inflow on Accuracy of Determining Formation Parameters with Formation Testers"; 1971; pp. 11-14; No. 1; Nefteprom. Delo; Russia. (Partial translation attached).
Mark A. Proett et al.; "Supercharge Pressure Compensation Using a New Wireline Testing Method and Newly Developed Early Time Spherical Flow Model"; 1996 SPE Annual Technical Conference and Exhibition; Oct. 6-9, 1996; pp. 329-342; SPE 36524; Society of Petroleum Engineers, Inc.; Denver, Colorado, U.S.A.
G.D. Phelps et al.; "The Analysis of the Invaded Zone Characteristics and Their Infuence on Wireline Log and Well-Test Interpretation"; 1984 Society of Petroleum Engineers of AIME 59th Annual Conference and Exhibition; Sep. 16-19, 1984; pp. 1-10; Tables 1-4; Figures 1-14; SPE 13287; Society of Petroleum Engineers of AIME; Houston, Texas, U.S.A.
D.K. Sethi et al.; "The Formation Multi-Tester: Its Basic Principles and Practical Field Applications"; SPWLA Twenty-First Annual Logging Symposium; Jul. 8-11, 1980; pp. 1-34.
M.M. Kamal et al.; "Use of Transient Testing in Reservoir Management"; University of Tulsa Centennial Petroleum Engineering Symposium; Aug. 29-31, 1994; pp. 519-531; SPE 28008; Society of Petroleum Engineers; Tulsa, Oklahoma, U.S.A.
"Well Testing Using Wireline Methods"; Schlumberger East Asia Well Evaluation Conference; 1981; pp. 121-144; Singapore.
R. Desbrandes et al.; "Wettability and Productivity Characterization of Low Permeability Gas Formations: Annual Report"; Gas Research Institute; Report GRI-91/0135; Mar. 6, 1991.
T. M. Whittle et al.; "Will Wireline Formation Tests Replace Well Tests?"; 2003 SPE Annual Technical Conference and Exhibition; Oct. 5-8, 2003; pp. 57-58; SPE 84086; Society of Petroleum Engineers, Inc.; Denver, Colorado, U.S.A.
J. Michaels et al.; "Wireline Fluid Sampling"; 1995 SPE Annual Technical Conference and Exhibition; Oct. 22-25, 2005; pp. 871-878; SPE 36010; Society of Petroleum Engineers, Inc.; Dallas, Texas, U.S.A.
E. C. Thomas; "Wireline Formation Tester Data: Fact or Fiction"; Petrophysics, vol. 41, No. 5, Sep.-Oct. 2000; pp. 375-378.
R. Desbrandes; "Wireline Formation Testing: A New Extended Drawdown Technique"; Petroleum Engineer International; pp. 40-44; May 1991.

* cited by examiner

METHODS AND APPARATUS FOR USING FORMATION PROPERTY DATA

CROSS-REFERENCE TO RELATED APPLICATIONS

The present application claims the benefit of U.S. Provisional Application Ser. No. 60/573,286, filed May 21, 2004, entitled Methods and Apparatus for Using Formation Property Data, which is hereby incorporated herein by reference.

STATEMENT REGARDING FEDERALLY SPONSORED RESEARCH OR DEVELOPMENT

Not applicable.

BACKGROUND

During the drilling and completion of oil and gas wells, it may be necessary to engage in ancillary operations, such as monitoring the operability of equipment used during the drilling process or evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint and formation pressure gradient. These tests are performed in order to determine whether commercial exploitation of the intersected formations is viable and how to optimize production.

Wireline formation testers (WFT) and drill stem testing (DST) have been commonly used to perform these tests. The basic DST test tool consists of a packer or packers, valves or ports that may be opened and closed from the surface, and two or more pressure-recording devices. The tool is lowered on a work string to the zone to be tested. The packer or packers are set, and drilling fluid is evacuated to isolate the zone from the drilling fluid column. The valves or ports are then opened to allow flow from the formation to the tool for testing while the recorders chart static pressures. A sampling chamber traps clean formation fluids at the end of the test. WFTs generally employ the same testing techniques but use a wireline to lower the test tool into the well bore after the drill string has been retrieved from the well bore, although WFT technology is sometimes deployed on a pipe string. The wireline tool typically uses packers also, although the packers are placed closer together, compared to drill pipe conveyed testers, for more efficient formation testing. In some cases, packers are not used. In those instances, the testing tool is brought into contact with the intersected formation and testing is done without zonal isolation across the axial span of the circumference of the borehole wall.

WFTs may also include a probe assembly for engaging the borehole wall and acquiring formation fluid samples. The probe assembly may include an isolation pad to engage the borehole wall. The isolation pad seals against the formation and around a hollow probe, which places an internal cavity in fluid communication with the formation. This creates a fluid pathway that allows formation fluid to flow between the formation and the formation tester while isolated from the borehole fluid.

In order to acquire a useful sample, the probe must stay isolated from the relative high pressure of the borehole fluid. Therefore, the integrity of the seal that is formed by the isolation pad is critical to the performance of the tool. If the borehole fluid is allowed to leak into the collected formation fluids, a non-representative sample will be obtained and the test will have to be repeated.

Examples of isolation pads and probes used in WFTs can be found in Halliburton's DT, SFTT, SFT4, and RDT tools. Isolation pads that are used with WFTs are typically rubber pads affixed to the end of the extending sample probe. The rubber is normally affixed to a metallic plate that provides support to the rubber as well as a connection to the probe. These rubber pads are often molded to fit within the specific diameter hole in which they will be operating.

With the use of WFTs and DSTs, the drill string with the drill bit must be retracted from the borehole. Then, a separate work string containing the testing equipment, or, with WFTs, the wireline tool string, must be lowered into the well to conduct secondary operations. Interrupting the drilling process to perform formation testing can add significant amounts of time to a drilling program.

DSTs and WFTs may also cause tool sticking or formation damage. There may also be difficulties of running WFTs in highly deviated and extended reach wells. WFTs also do not have flowbores for the flow of drilling mud, nor are they designed to withstand drilling loads such as torque and weight on bit.

Further, the formation pressure measurement accuracy of drill stem tests and, especially, of wireline formation tests may be affected by filtrate invasion and mudcake buildup because significant amounts of time may have passed before a DST or WFT engages the formation. Mud filtrate invasion occurs when the drilling mud fluids displace formation fluids. Because the mud filtrate ingress into the formation begins at the borehole surface, it is most prevalent there and generally decreases further into the formation. When filtrate invasion occurs, it may become impossible to obtain a representative sample of formation fluids or, at a minimum, the duration of the sampling period must be increased to first remove the drilling fluid and then obtain a representative sample of formation fluids. The mudcake is made up of the solid particles that are plastered to the side of the well by the circulating drilling mud during drilling. The prevalence of the mudcake at the borehole surface creates a "skin." Thus there may be a "skin effect" because formation testers can only extend relatively short distances into the formation, thereby distorting the representative sample of formation fluids due to the filtrate. The mudcake also acts as a region of reduced permeability adjacent to the borehole. Thus, once the mudcake forms, the accuracy of reservoir pressure measurements decreases, affecting the calculations for permeability and producibility of the formation.

Another testing apparatus is the formation tester while drilling (FTWD) tool. Typical FTWD formation testing equipment is suitable for integration with a drill string during drilling operations. Various devices or systems are used for isolating a formation from the remainder of the borehole, drawing fluid from the formation, and measuring physical properties of the fluid and the formation. For example, the FTWD may use a probe similar to a WFT that extends to the formation and a small sample chamber to draw in formation fluids through the probe to test the formation pressure. To perform a test, the drill string is stopped from rotating and the test procedure, similar to a WFT described above, is performed.

BRIEF DESCRIPTION OF THE DRAWINGS

For a more detailed description of the embodiments of the present invention, reference will now be made to the accompanying drawings, wherein.

DETAILED DESCRIPTION OF PREFERRED EMBODIMENTS

Figure 1:
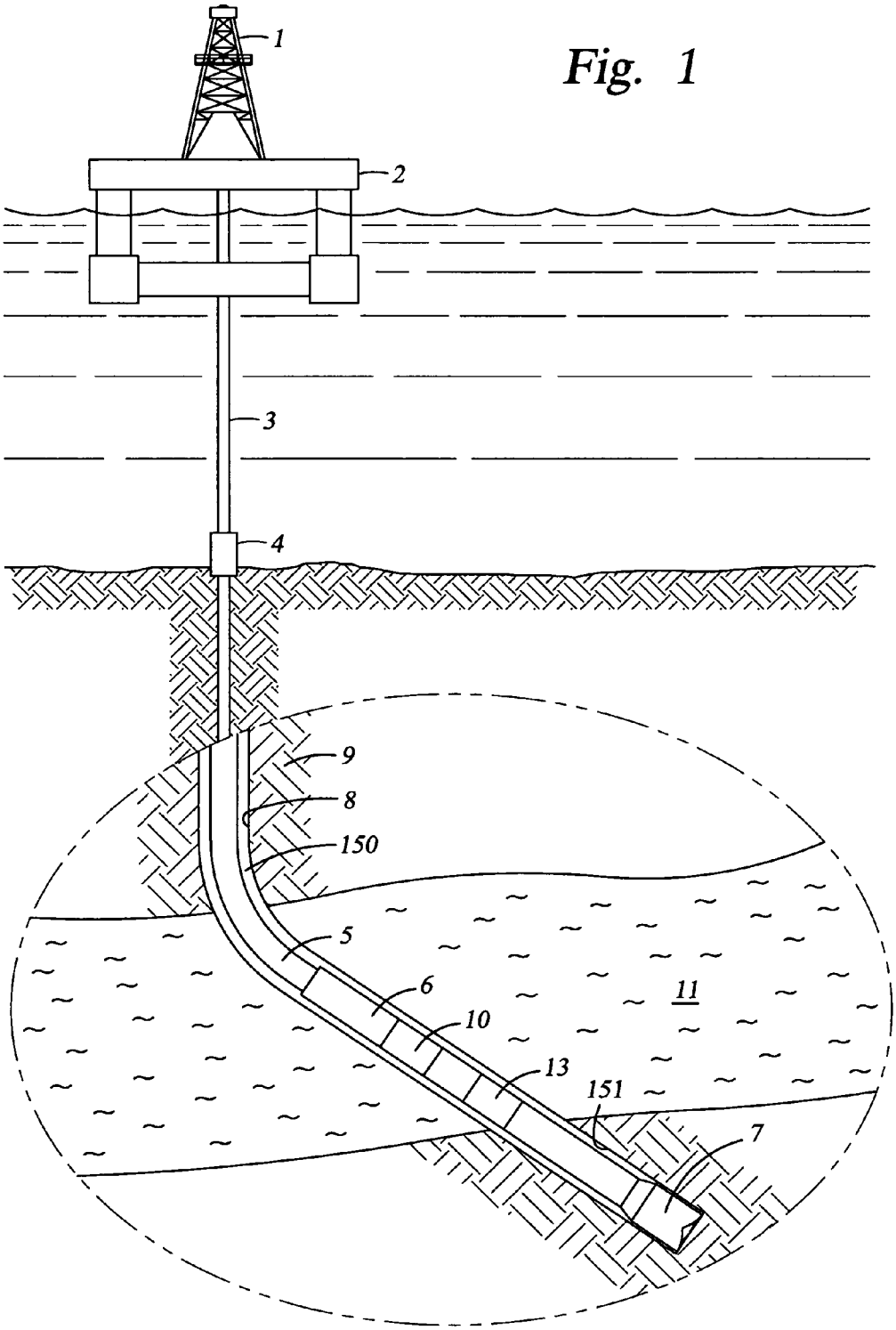
FIG. 1 is a schematic elevation view, partly in cross-section, of an embodiment of a formation tester apparatus disposed in a subterranean well.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the terms "couple," "couples", and "coupled" used to describe any electrical connections are each intended to mean and refer to either an indirect or a direct electrical connection. Thus, for example, if a first device "couples" or is "coupled" to a second device, that interconnection may be through an electrical conductor directly interconnecting the two devices, or through an indirect electrical connection via other devices, conductors and connections. Further, reference to "up" or "down" are made for purposes of ease of description with "up" meaning towards the surface of the borehole and "down" meaning towards the bottom or distal end of the borehole. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems.

To understand the mechanics of formation testing, it is important to first understand how hydrocarbons are stored in subterranean formations. Hydrocarbons are not typically located in large underground pools, but are instead found within very small holes, or pore spaces, within certain types of rock. Therefore, it is critical to know certain properties of both the formation and the fluid contained therein. At various times during the following discussion, certain formation and formation fluid properties will be referred to in a general sense. Such formation properties include, but are not limited to: pressure, permeability, viscosity, mobility, spherical mobility, porosity, saturation, coupled compressibility porosity, skin damage, and anisotropy. Such formation fluid properties include, but are not limited to: viscosity, compressibility, flowline fluid compressibility, density, resistivity, composition and bubble point.

Permeability is the ability of a rock formation to allow hydrocarbons to move between its pores, and consequently into a wellbore. Fluid viscosity is a measure of the ability of the hydrocarbons to flow, and the permeability divided by the viscosity is termed "mobility." Porosity is the ratio of void space to the bulk volume of rock formation containing that void space. Saturation is the fraction or percentage of the pore volume occupied by a specific fluid (e.g., oil, gas, water, etc.). Skin damage is an indication of how the mud filtrate or mud cake has changed the permeability near the wellbore. Anisotropy is the ratio of the vertical and horizontal permeabilities of the formation.

Resistivity of a fluid is the property of the fluid which resists the flow of electrical current. Bubble point occurs when a fluid's pressure is brought down at such a rapid rate, and to a low enough pressure, that the fluid, or portions thereof, changes phase to a gas. The dissolved gases in the fluid are brought out of the fluid so gas is present in the fluid in an undissolved state. Typically, this kind of phase change in the formation hydrocarbons being tested and measured is undesirable, unless the bubblepoint test is being administered to determine what the bubblepoint pressure is.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring to FIG. 1, an MWD formation tester tool 10 is illustrated as a part of bottom hole assembly 6 (BHA) which includes an MWD sub 13 and a drill bit 7 at its lower most end. BHA 6 is lowered from a drilling platform 2, such as a ship or other conventional platform, via drill string 5. Drill string 5 is disposed through riser 3 and well head 4. Conventional drilling equipment (not shown) is supported within derrick 1 and rotates drill string 5 and drill bit 7, causing bit 7 to form a borehole 8 through the formation material 9. The borehole 8 penetrates subterranean zones or reservoirs, such as reservoir 11, that are believed to contain hydrocarbons in a commercially viable quantity. It should be understood that formation tester 10 may be employed in other bottom hole assemblies and with other drilling apparatus in land-based drilling, as well as offshore drilling as illustrated in FIG. 1. In all instances, in addition to formation tester 10, the bottom hole assembly 6 contains various conventional apparatus and systems, such as a down hole drill motor, mud pulse telemetry system, measurement-while-drilling sensors and systems, and others well known in the art.

It should also be understood that, even though the MWD formation tester 10 is illustrated as part of a drill string 5, the embodiments of the invention described below may be conveyed down the borehole 8 via wireline technology, as is partially described above. It should also be understood that the exact physical configuration of the formation tester and the probe assembly is not a requirement of the present invention. The embodiment described below serves to provide an example only. Additional examples of a probe assembly and methods of use are described in U.S. patent application Ser. No. 10/440,593, filed May 19, 2003 and entitled "Method and Apparatus for MWD Formation Testing"; Ser. No. 10/440,835, filed May 19, 2003 and entitled "MWD Formation Tester"; and Ser. No. 10/440,637, filed May 19, 2003 and entitled "Equalizer Valve"; each hereby incorporated herein by reference for all purposes. Further examples of formation testing tools, probe assemblies and methods of use, whether conveyed via a drill string or wireline, or any other method, include U.S. patent application entitled "Downhole Probe Assembly," having U.S. Express Mail Label Number EV 303483549 US and Ser. No. 11/133,643; U.S. patent application entitled "Formation Tester Tool Assembly and Methods of Use," having U.S. Express Mail Label Number EV 303483552 US and Ser. No. 11/135,050; U.S. patent application entitled "Methods and Apparatus for Measuring Formation Properties," having U.S. Express Mail Label Number EV 303483566 US and Ser. No. 11/135,050; U.S. patent application entitled "Methods and Apparatus for Controlling a Formation Tester Tool Assembly," having U.S. Express Mail Label Number EV 303483362 US and Ser. No. 11/132,475; and U.S. patent application entitled "Methods for Measuring a Formation Supercharge Pressure," having U.S. patent application Ser. No. 11/069,649; each hereby incorporated herein by reference for all purposes.

The formation tester tool 10 is best understood with reference to FIGS. 2A-2E. Formation tester 10 generally comprises a heavy walled housing 12 made of multiple sections of drill collar 12*a*, 12*b*, 12*c*, and 12*d* which threadedly engage one another so as to form the complete housing 12. Bottom hole assembly 6 includes flow bore 14 formed through its entire length to allow passage of drilling fluids from the surface through the drill string 5 and through the bit 7. The drilling fluid passes through nozzles in the drill bit face and flows upwards through borehole 8 along the annulus 150 formed between housing 12 and borehole wall 151.

Figure 2A:
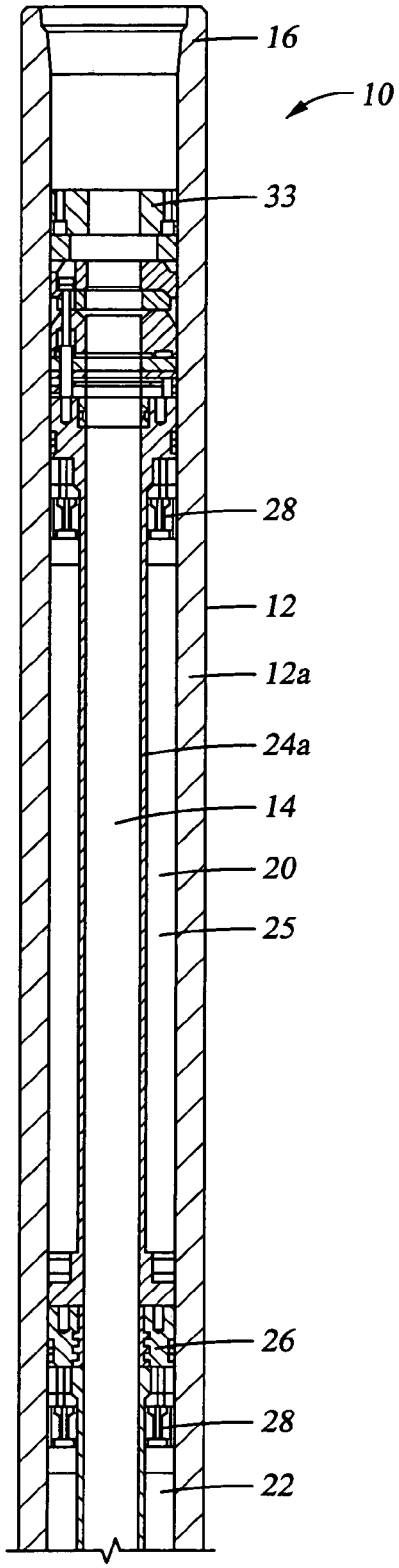
FIGS. 2A-2E are schematic elevation views, partly in cross-section, of portions of the bottomhole assembly and formation tester assembly shown in FIG. 1.
Figure 2B:
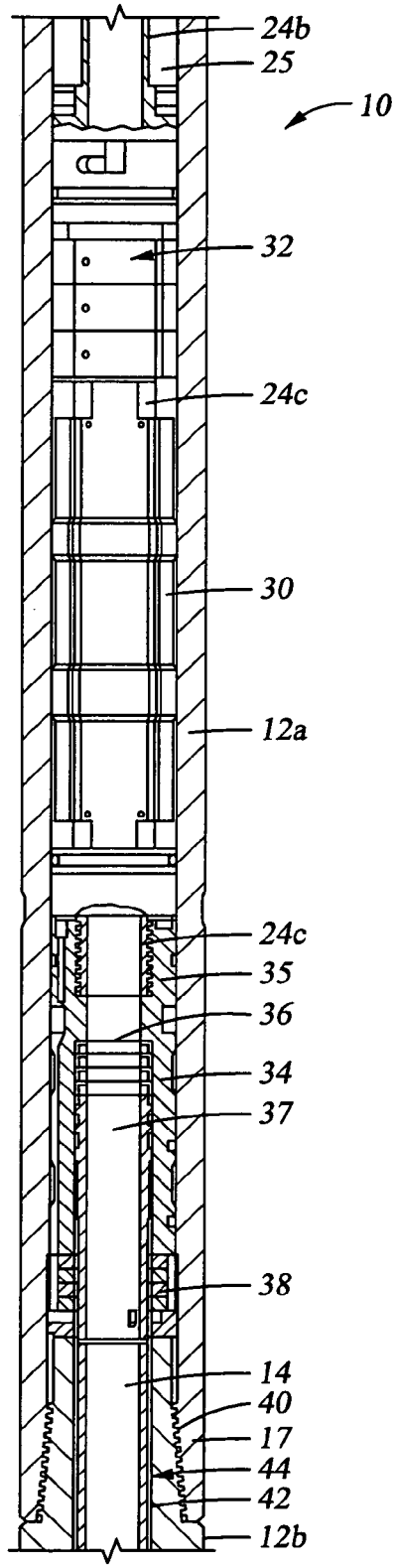

Referring to FIGS. 2A and 2B, upper section 12*a* of housing 12 includes upper end 16 and lower end 17. Upper end 16 includes a threaded box for connecting formation tester 10 to drill string 5. Lower end 17 includes a threaded box for receiving a correspondingly threaded pin end of housing section 12*b*. Disposed between ends 16 and 17 in housing section 12*a* are three aligned and connected sleeves or tubular inserts 24*a,b,c* which creates an annulus 25 between sleeves 24*a,b,c* and the inner surface of housing section 12*a*. Annulus 25 is sealed from flowbore 14 and provided for housing a plurality of electrical components, including battery packs 20, 22. Battery packs 20, 22 are mechanically interconnected at connector 26. Electrical connectors 28 are provided to interconnect battery packs 20, 22 to a common power bus (not shown). Beneath battery packs 20, 22 and also disposed about sleeve insert 24*c* in annulus 25 is electronics module 30. Electronics module 30 includes the various circuit boards, capacitors banks and other electrical components, including the capacitors shown at 32. A connector 33 is provided adjacent upper end 16 in housing section 12*a* to electrically couple the electrical components in formation tester tool 10 with other components of bottom hole assembly 6 that are above housing 12.

Beneath electronics module 30 in housing section 12*a* is an adapter insert 34. Adapter 34 connects to sleeve insert 24*c* at connection 35 and retains a plurality of spacer rings 36 in a central bore 37 that forms a portion of flowbore 14. Lower end 17 of housing section 12*a* connects to housing section 12*b* at threaded connection 40. Spacers 38 are disposed between the lower end of adapter 34 and the pin end of housing section 12*b*. Because threaded connections such as connection 40, at various times, need to be cut and repaired, the length of sections 12*a*, 12*b* may vary in length. Employing spacers 36, 38 allow for adjustments to be made in the length of threaded connection 40.

Housing section 12*b* includes an inner sleeve 44 disposed therethrough. Sleeve 44 extends into housing section 12*a* above, and into housing section 12*c* below. The upper end of sleeve 44 abuts spacers 36 disposed in adapter 34 in housing section 12*a*. An annular area 42 is formed between sleeve 44 and the wall of housing 12*b* and forms a wire way for electrical conductors that extend above and below housing section 12*b*, including conductors controlling the operation of formation tester 10 as described below.

Figure 2C:
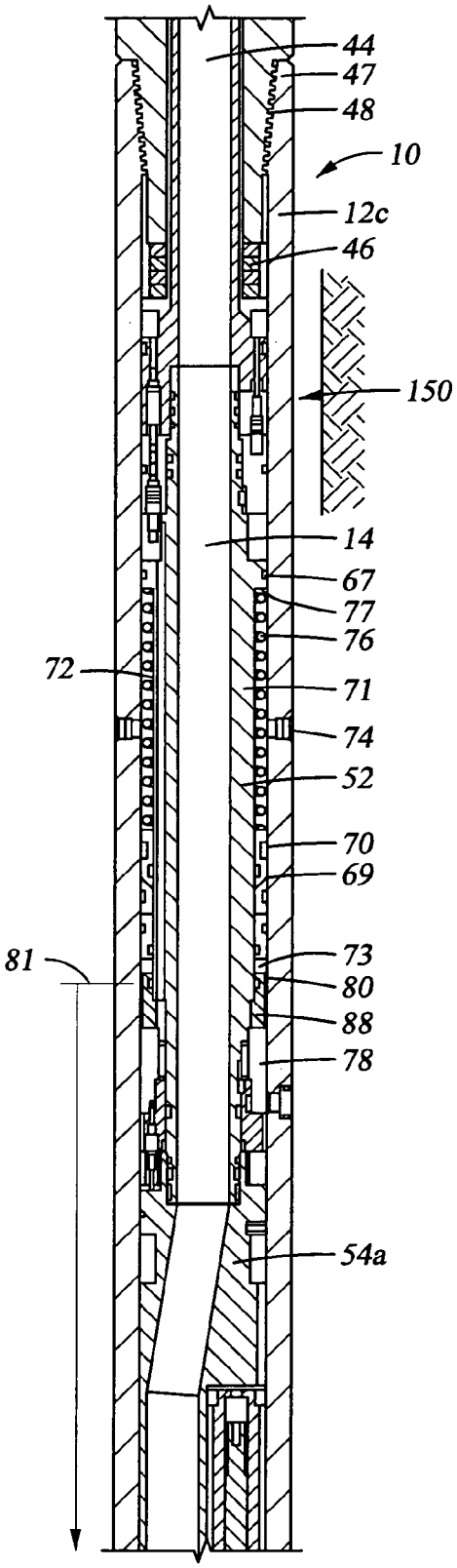
Figure 5:
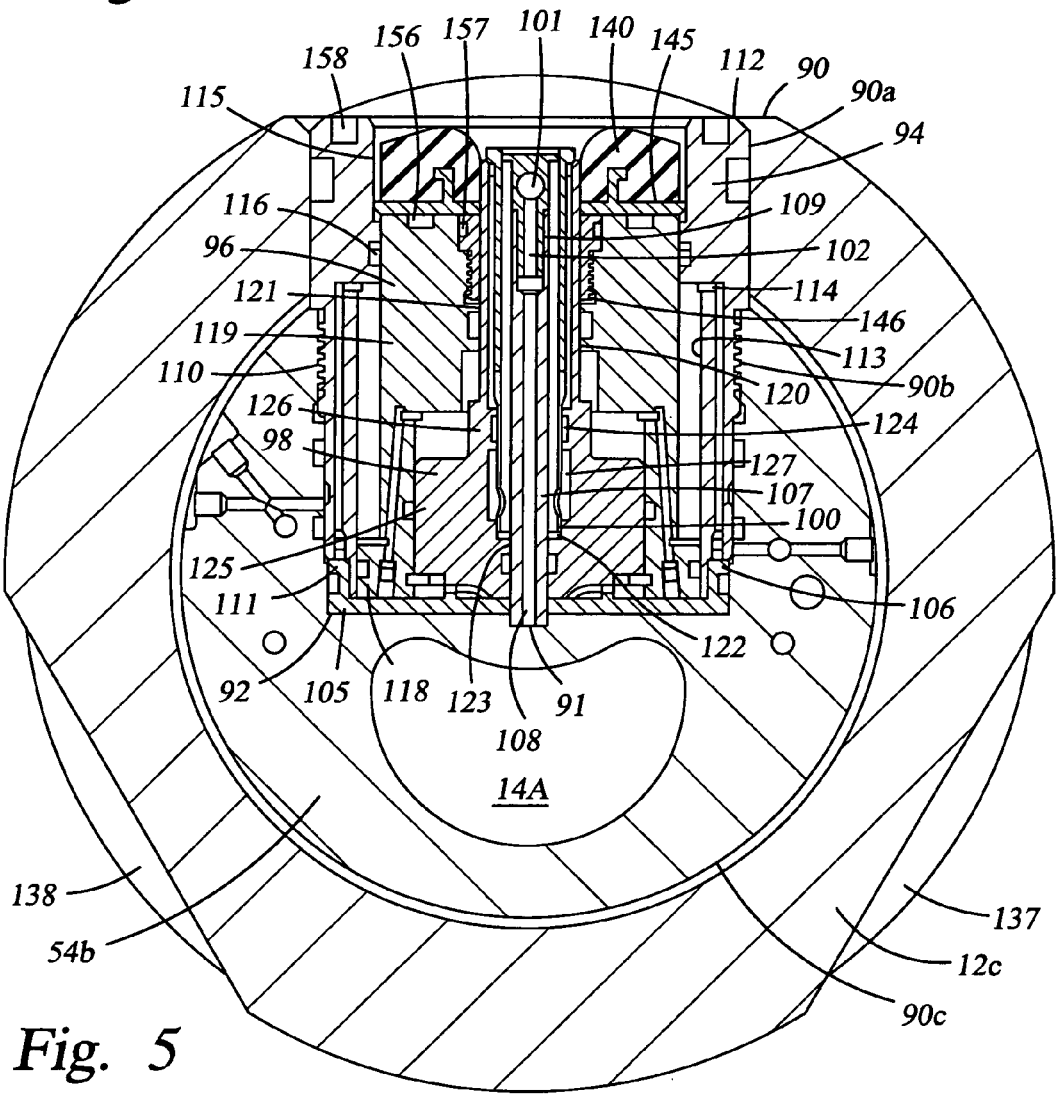
FIG. 5 is a cross-sectional view of the formation probe assembly taken along line 5-5 shown in FIG. 4.

Referring now to FIGS. 2B and 2C, housing section 12*c* includes upper box end 47 and lower box end 48 which threadingly engage housing section 12*b* and housing section 12*c*, respectively. For the reasons previously explained, adjusting spacers 46 are provided in housing section 12*c* adjacent to end 47. As previously described, insert sleeve 44 extends into housing section 12*c* where it stabs into inner mandrel 52. The lower end of inner mandrel 52 stabs into the upper end of formation tester mandrel 54, which is comprised of three axially aligned and connected sections 54*a*, *b*, and *c*. Extending through mandrel 54 is a deviated flowbore portion 14*a*. Deviating flowbore 14 into flowbore path 14*a* provides sufficient space within housing section 12*c* for the formation tool components described in more detail below. As best shown in FIG. 2E, deviated flowbore 14*a* eventually centralizes near the lower end 48 of housing section 12*c*, shown generally at location 56. Referring momentarily to FIG. 5, the cross-sectional profile of deviated flowbore 14*a* may be a non-circular in segment 14*b*, so as to provide as much room as possible for the formation probe assembly 50.

Figure 2D:
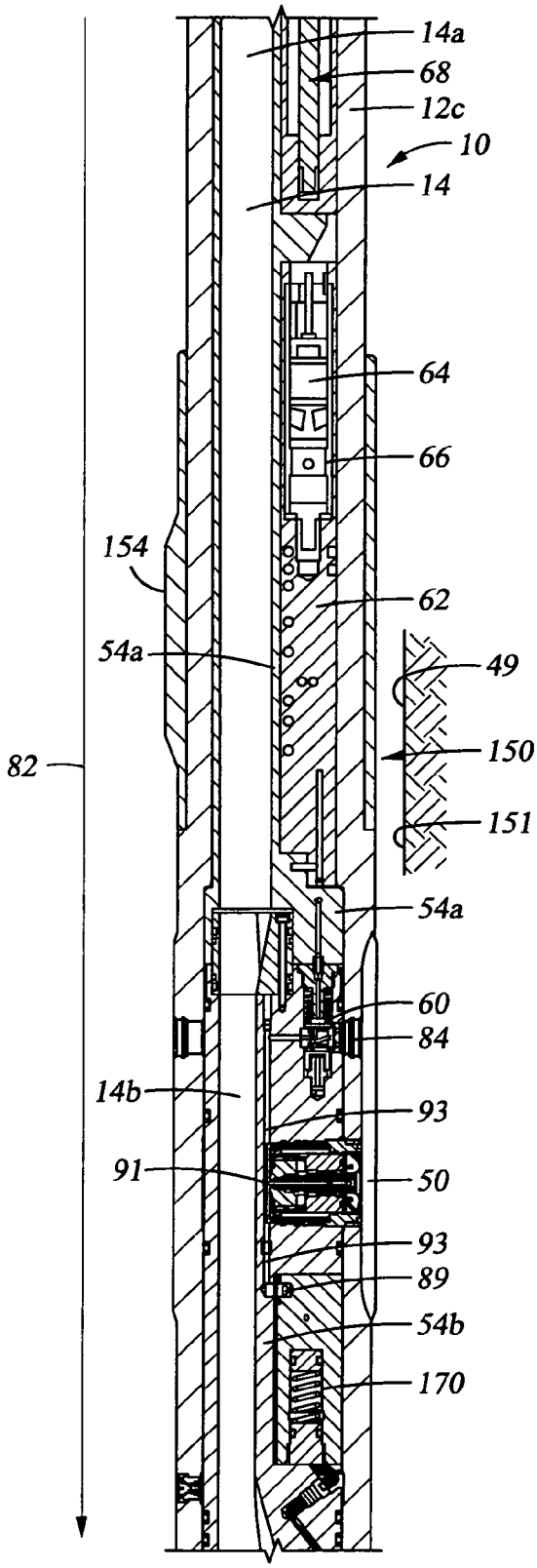
Figure 2E:
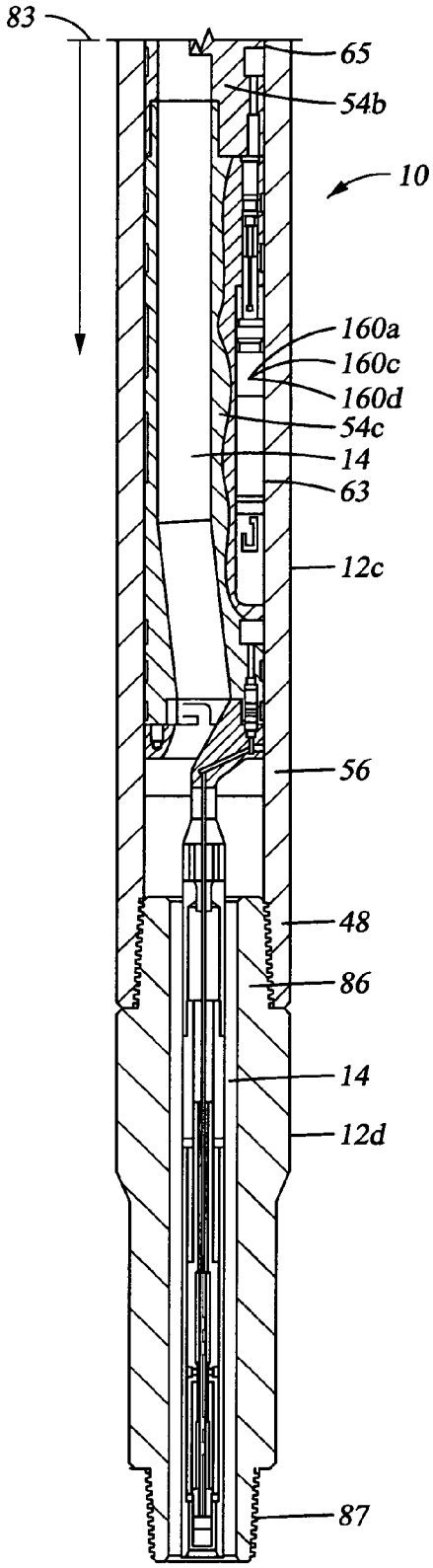

As best shown in FIGS. 2D and 2E, disposed about formation tester mandrel 54 and within housing section 12*c* are electric motor 64, hydraulic pump 66, hydraulic mani fold 62, equalizer valve 60, formation probe assembly 50, pressure transducers 160, and draw down piston 170. Hydraulic accumulators provided as part of the hydraulic system for operating formation probe assembly 50 are also disposed about mandrel 54 in various locations, one such accumulator 68 being shown in FIG. 2D.

Electric motor 64 may be a permanent magnet motor powered by battery packs 20, 22 and capacitor banks 32. Motor 64 is interconnected to and drives hydraulic pump 66. Pump 66 provides fluid pressure for actuating formation probe assembly 50. Hydraulic manifold 62 includes various solenoid valves, check valves, filters, pressure relief valves, thermal relief valves, pressure transducer 160*b* and hydraulic circuitry employed in actuating and controlling formation probe assembly 50 as explained in more detail below.

Referring again to FIG. 2C, mandrel 52 includes a central segment 71. Disposed about segment 71 of mandrel 52 are pressure balance piston 70 and spring 76. Mandrel 52 includes a spring stop extension 77 at the upper end of segment 71. Stop ring 88 is threaded to mandrel 52 and includes a piston stop shoulder 80 for engaging corresponding annular shoulder 73 formed on pressure balance piston 70. Pressure balance piston 70 further includes a sliding annular seal or barrier 69. Barrier 69 consists of a plurality of inner and outer o-ring and lip seals axially disposed along the length of piston 70.

Beneath piston 70 and extending below inner mandrel 52 is a lower oil chamber or reservoir 78, described more fully below. An upper chamber 72 is formed in the annulus between central portion 71 of mandrel 52 and the wall of housing section 12*c*, and between spring stop portion 77 and pressure balance piston 70. Spring 76 is retained within chamber 72. Chamber 72 is open through port 74 to annulus 150. As such, drilling fluids will fill chamber 72 in operation. An annular seal 67 is disposed about spring stop portion 77 to prevent drilling fluid from migrating above chamber 72.

Barrier 69 maintains a seal between the drilling fluid in chamber 72 and the hydraulic oil that fills and is contained in oil reservoir 78 beneath piston 70. Lower chamber 78 extends from barrier 69 to seal 65 located at a point generally noted as 83 and just above transducers 160 in FIG. 2E. The oil in reservoir 78 completely fills all space between housing section 12*c* and formation tester mandrel 54. The hydraulic oil in chamber 78 may be maintained at slightly greater pressure than the hydrostatic pressure of the drilling fluid in annulus 150. The annulus pressure is applied to piston 70 via drilling fluid entering chamber 72 through port 74. Because lower oil chamber 78 is a closed system, the annulus pressure that is applied via piston 70 is applied to the entire chamber 78. Additionally, spring 76 provides a slightly greater pressure to the closed oil system 78 such that the pressure in oil chamber 78 is substantially equal to the annulus fluid pressure plus the pressure added by the spring force. This slightly greater oil pressure is desirable so as to maintain positive pressure on all the seals in oil chamber 78. Having these two pressures generally balanced (even though the oil pressure is slightly higher) is easier to maintain than if there was a large pressure differential between the hydraulic oil and the drilling fluid. Between barrier 69 in piston 70 and point 83, the hydraulic oil fills all the space between the outside diameter of mandrels 52, 54 and the inside diameter of housing section 12*c*, this region being marked as distance 82 between points 81 and 83. The oil in reservoir 78 is employed in the hydraulic circuit 200 (FIG. 9) used to operate and control formation probe assembly 50 as described in more detailed below.

Figure 3:
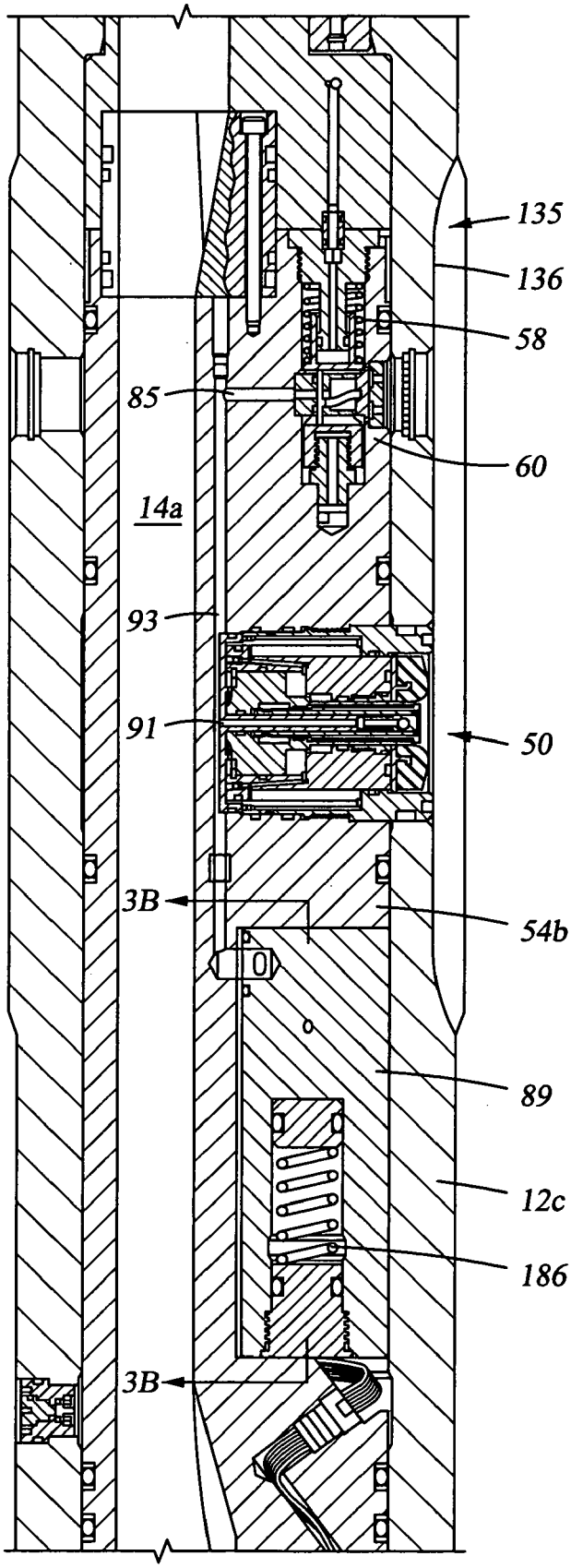
FIG. 3 is an enlarged elevation view, partly in cross-section, of the formation tester tool portion of the formation tester assembly shown in FIG. 2D.
Figure 3B:
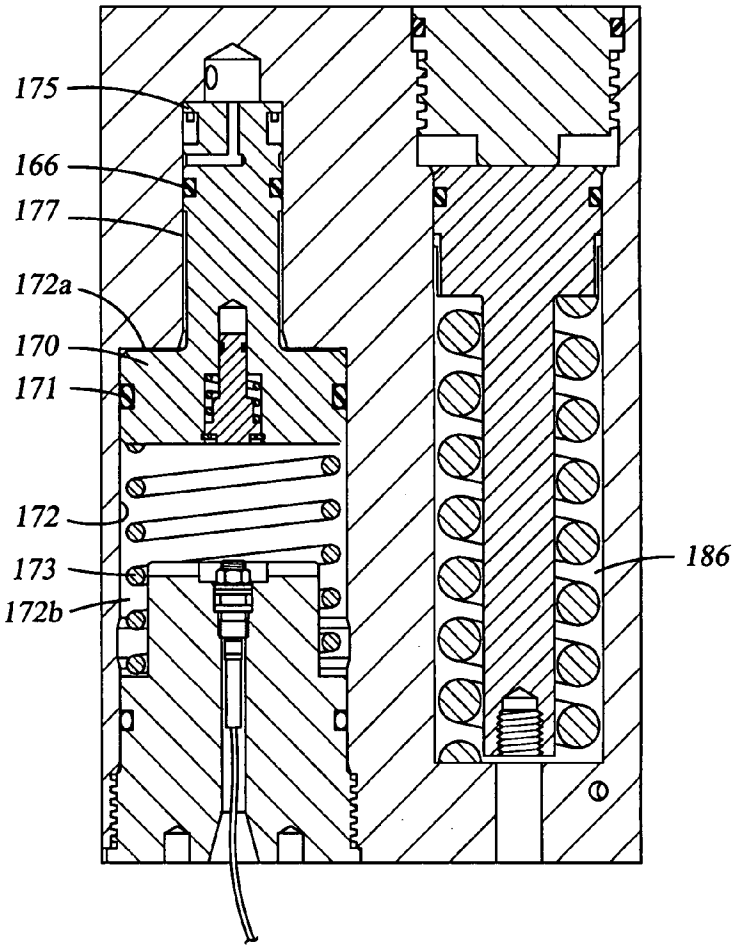
FIG. 3B is an enlarged cross-section view along line 3B-3B of FIG. 3.

Equalizer valve 60, best shown in FIG. 3, is disposed in formation tester mandrel 54*b* between hydraulic manifold 62 and formation probe assembly 50. Equalizer valve 60 is in fluid communication with hydraulic passageway 85 and with longitudinal fluid passageway 93 formed in mandrel 54*b*. Prior to actuating formation probe assembly 50 so as to test the formation, drilling fluid fills passageways 85 and 93 as valve 60 is normally open and communicates with annulus 150 through port 84 in the wall of housing section 12*c*. When the formation fluids are being sampled by formation probe assembly 50, valve 60 closes the passageway 85 to prevent drilling fluids from annulus 150 entering passageway 85 or passageway 93.

Figure 4:
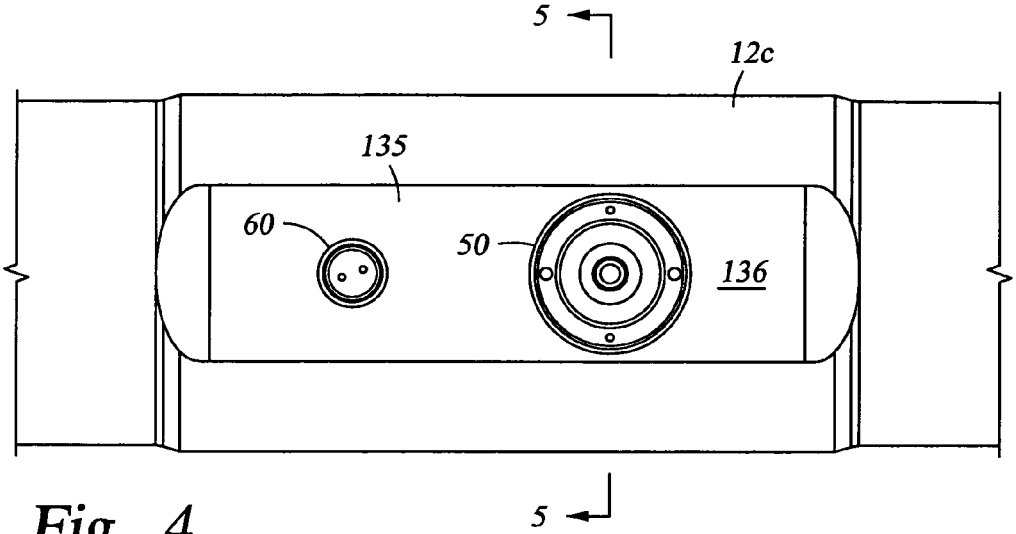
FIG. 4 is an elevation view of the formation tester tool shown in FIG. 3.

As shown in FIGS. 3 and 4, housing section 12*c* includes a recessed portion 135 adjacent to formation probe assembly 50 and equalizer valve 60. The recessed portion 135 includes a planar surface or "flat" 136. The ports through which fluids may pass into equalizing valve 60 and probe assembly 50 extend through flat 136. In this manner, as drill string 5 and formation tester 10 are rotated in the borehole, formation probe assembly 50 and equalizer valve 60 are better protected from impact, abrasion and other forces. Flat 136 is recessed at least ¼ inch and may be at least ½ inch from the outer diameter of housing section 12*c*. Similar flats 137, 138 are also formed about housing section 12*c* at generally the same axial position as flat 136 to increase flow area for drilling fluid in the annulus 150 of borehole 8.

Disposed about housing section 12*c* adjacent to formation probe assembly 50 is stabilizer 154. Stabilizer 154 may have an outer diameter close to that of nominal borehole size. As explained below, formation probe assembly 50 includes a seal pad 140 that is extendable to a position outside of housing 12*c* to engage the borehole wall 151. As explained, probe assembly 50 and seal pad 140 of formation probe assembly 50 are recessed from the outer diameter of housing section 12*c*, but they are otherwise exposed to the environment of annulus 150 where they could be impacted by the borehole wall 151 during drilling or during insertion or retrieval of bottom hole assembly 6. Accordingly, being positioned adjacent to formation probe assembly 50, stabilizer 154 provides additional protection to the seal pad 140 during insertion, retrieval and operation of bottom hole assembly 6. It also provides protection to pad 140 during operation of formation tester 10. In operation, a piston extends seal pad 140 to a position where it engages the borehole wall 151. The force of the pad 140 against the borehole wall 151 would tend to move the formation tester 10 in the borehole, and such movement could cause pad 140 to become damaged. However, as formation tester 10 moves sideways within the borehole as the piston is extended into engagement with the borehole wall 151, stabilizer 154 engages the borehole wall and provides a reactive force to counter the force applied to the piston by the formation. In this manner, further movement of the formation test tool 10 is resisted.

Referring to FIG. 2E, mandrel 54*c* contains chamber 63 for housing pressure transducers 160*a, c*, and *d* as well as electronics for driving and reading these pressure transducers. In addition, the electronics in chamber 63 contain memory, a microprocessor, and power conversion circuitry for properly utilizing power from a power bus (not shown).

Referring still to FIG. 2E, housing section 12*d* includes pins ends 86, 87. Lower end 48 of housing section 12*c* threadedly engages upper end 86 of housing section 12*d*. Beneath housing section 12*d*, and between formation tester tool 10 and drill bit 7 are other sections of the bottom hole assembly 6 that constitute conventional MWD tools, generally shown in FIG. 1 as MWD sub 13. In a general sense, housing section 12*d* is an adapter used to transition from the lower end of formation tester tool 10 to the remainder of the bottom hole assembly 6. The lower end 87 of housing section 12*d* threadedly engages other sub assemblies included in bottom hole assembly 6 beneath formation tester tool 10. As shown, flowbore 14 extends through housing section 12*d* to such lower subassemblies and ultimately to drill bit 7.

Figure 3A:
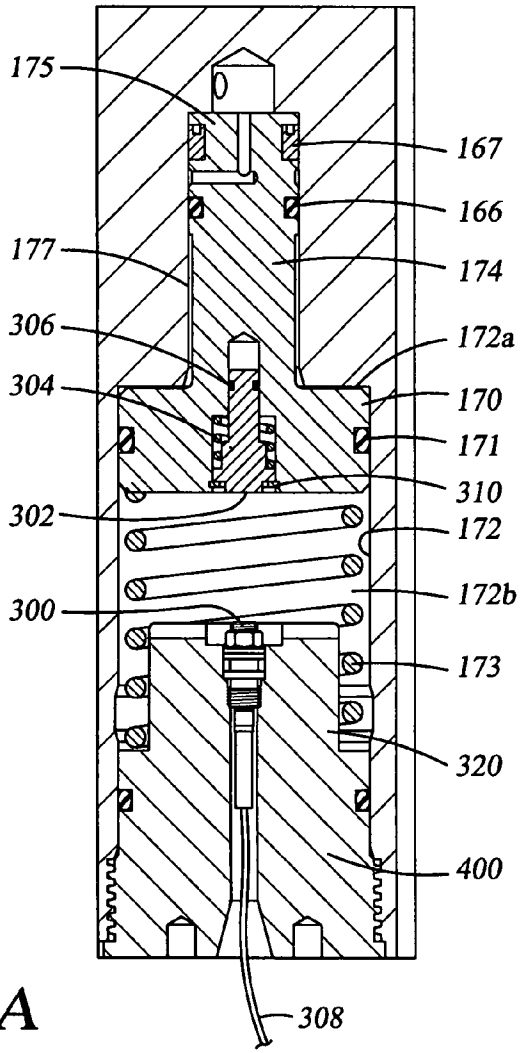
FIG. 3A is an enlarged cross-section view of the draw down piston and chamber shown in FIG. 3.

Referring again to FIG. 3 and to FIG. 3A, drawdown piston 170 is retained in drawdown manifold 89 that is mounted on formation tester mandrel 54*b* within housing 12*c*. Piston 170 includes annular seal 171 and is slidingly received in cylinder 172. Spring 173 biases piston 170 to its uppermost or shouldered position as shown in FIG. 3A. Separate hydraulic lines (not shown) interconnect with cylinder 172 above and below piston 170 in portions 172*a*, 172*b* to move piston 170 either up or down within cylinder 172 as described more fully below. A plunger 174 is integral with and extends from piston 170. Plunger 174 is slidingly disposed in cylinder 177 coaxial with 172. Cylinder 175 is the upper portion of cylinder 177 that is in fluid communication with the longitudinal passageway 93 as shown in FIG. 3A. Cylinder 175 is flooded with drilling fluid via its interconnection with passageway 93. Cylinder 177 is filled with hydraulic fluid beneath seal 166 via its interconnection with hydraulic circuit 200. Plunger 174 also contains scraper 167 that protects seal 166 from debris in the drilling fluid. Scraper 167 may be an o-ring energized lip seal.

As best shown in FIG. 5, formation probe assembly 50 generally includes stem 92, a generally cylindrical adapter sleeve 94, piston 96 adapted to reciprocate within adapter sleeve 94, and a snorkel assembly 98 adapted for reciprocal movement within piston 96. Housing section 12*c* and formation tester mandrel 54*b* include aligned apertures 90*a*, 90*b*, respectively, that together form aperture 90 for receiving formation probe assembly 50.

Stem 92 includes a circular base portion 105 with an outer flange 106. Extending from base 105 is a tubular extension 107 having central passageway 108. The end of extension 107 includes internal threads at 109. Central passageway 108 is in fluid connection with fluid passageway 91 that, in turn, is in fluid communication with longitudinal fluid chamber or passageway 93, best shown in FIG. 3.

Adapter sleeve 94 includes inner end 111 that engages flange 106 of stem number 92. Adapter sleeve 94 is secured within aperture 90 by threaded engagement with mandrel 54*b* at segment 110. The outer end 112 of adapter sleeve 94 extends to be substantially flushed with flat 136 formed in housing member 12*c*. Circumferentially spaced about the outermost surface of adapter sleeve 94 is a plurality of tool engaging recesses 158. These recesses are employed to thread adapter 94 into and out of engagement with mandrel 54*b*. Adapter sleeve 94 includes cylindrical inner surface 113 having reduced diameter portions 114, 115. A seal 116 is disposed in surface 114. Piston 96 is slidingly retained within adapter sleeve 94 and generally includes base section 118 and an extending portion 119 that includes inner cylindrical surface 120. Piston 96 further includes central bore 121.

Snorkel 98 includes a base portion 125, a snorkel extension 126, and a central passageway 127 extending through base 125 and extension 126.

Formation tester apparatus 50 is assembled such that piston base 118 is permitted to reciprocate along surface 113 of adapter sleeve 94. Similarly, snorkel base 125 is disposed within piston 96 and snorkel extension 126 is adapted for reciprocal movement along piston surface 120. Central passageway 127 of snorkel 98 is axially aligned with tubular extension 107 of stem 92 and with screen 100.

Figure 6C:
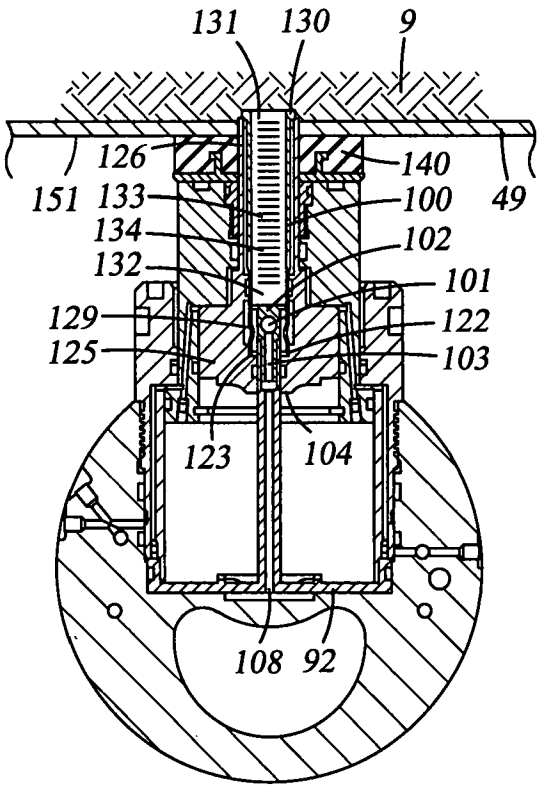
FIGS. 6A-6C are cross-sectional views of a portion of the formation probe assembly taken along the same line as seen in FIG. 5, the probe assembly being shown in a different position in each of FIGS. 6A-6C.

Referring to FIGS. 5 and 6C, screen 100 is a generally tubular member having a central bore 132 extending between a fluid inlet end 131 and outlet end 122. Outlet end 122 includes a central aperture 123 that is disposed about stem extension 107. Screen 100 further includes a flange 130 adjacent to fluid inlet end 131 and an internally slotted segment 133 having slots 134. Apertures 129 are formed in screen 100 adjacent end 122. Between slotted segment 133 and apertures 129, screen 100 includes threaded segment 124 for threadedly engaging snorkel extension 126.

Scraper 102 includes a central bore 103, threaded extension 104 and apertures 101 that are in fluid communication with central bore 103. Section 104 threadedly engages internally threaded section 109 of stem extension 107, and is disposed within central bore 132 of screen 100.

Figure 7:
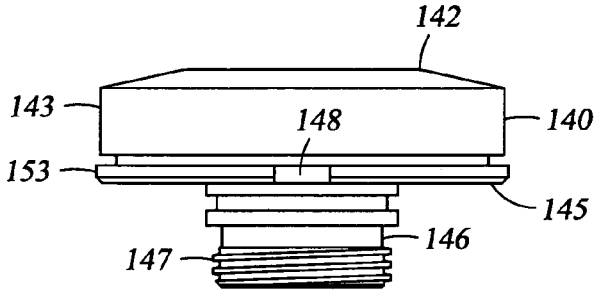
FIG. 7 is an elevation view of the probe pad mounted on the skirt employed in the formation probe assembly shown in FIGS. 4 and 5.
Figure 8:
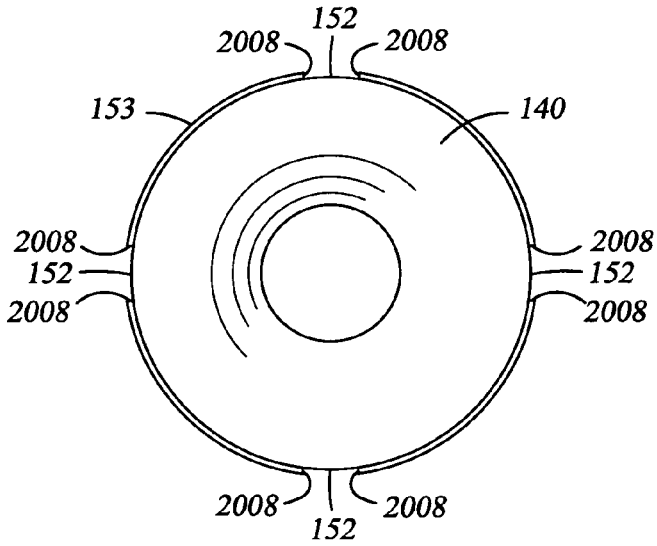
FIG. 8 is a top view of the probe pad shown in FIG. 7.

Referring now to FIGS. 5, 7 and 8, seal pad 140 may be generally donut-shaped having base surface 141, an opposite sealing surface 142 for sealing against the borehole wall, a circumferential edge surface 143 and a central aperture 144. In the embodiment shown, base surface 141 is generally flat and is bonded to a metal skirt 145 having circumferential edge 153 with recesses 152 and corners 2008. Seal pad 140 seals and prevents drilling fluid from entering the probe assembly 50 during formation testing so as to enable pressure transducers 160 to measure the pressure of the formation fluid. The rate at which the pressure measured by the formation test tool increases is an indication of the permeability of the formation 9. More specifically, seal pad 140 seals against the mudcake 49 that forms on the borehole wall 151. Typically, the pressure of the formation fluid is less than the pressure of the drilling fluids that are circulated in the borehole. A layer of residue from the drilling fluid forms a mudcake 49 on the borehole wall and separates the two pressure areas. Pad 140, when extended, conforms its shape to the borehole wall and, together with the mudcake 49, forms a seal through which formation fluids may be collected.

As best shown in FIGS. 3, 5, and 6, pad 140 is sized so that it may be retracted completely within aperture 90. In this position, pad 140 is protected both by flat 136 that surrounds aperture 90 and by recess 135 that positions face 136 in a setback position with respect to the outside surface of housing 12. Pad 140 is preferably made of an elastomeric material, but is not limited to such a material.

To help with a good pad seal, tool 10 may include, among other things, centralizers for centralizing the formation probe assembly 50 and thereby normalizing pad 140 relative to the borehole wall. For example, the formation tester may include centralizing pistons coupled to a hydraulic fluid circuit configured to extend the pistons in such a way as to protect the probe assembly and pad, and also to provide a good pad seal.

Figure 9:
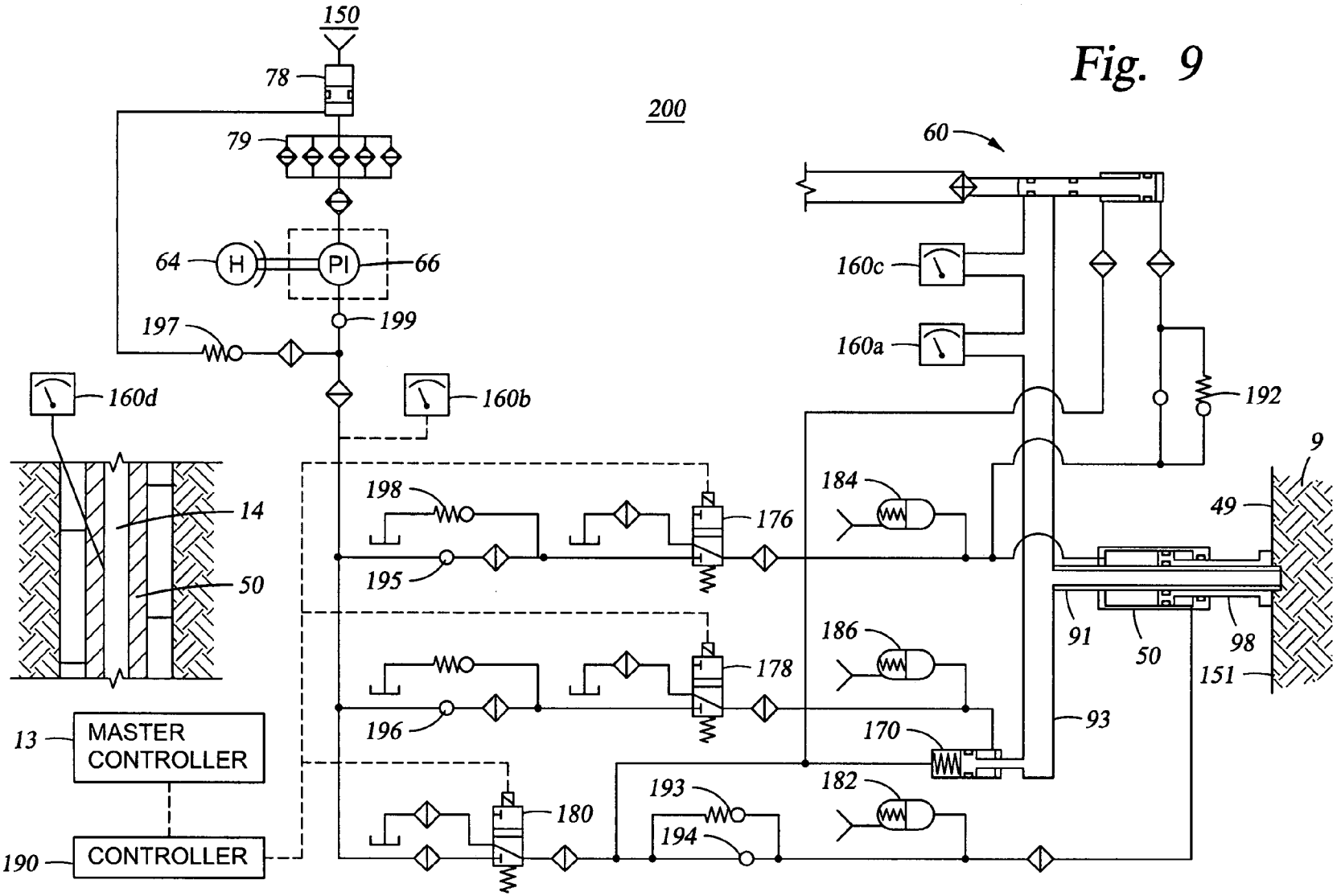
FIG. 9 is a schematic view of a hydraulic circuit employed in actuating the formation tester apparatus.

The hydraulic circuit 200 used to operate probe assembly 50, equalizer valve 60, and draw down piston 170 is illustrated in FIG. 9. A microprocessor-based controller 190 is electrically coupled to all of the controlled elements in the hydraulic circuit 200 illustrated in FIG. 10, although the electrical connections to such elements are conventional and are not illustrated other than schematically. Controller 190 is located in electronics module 30 in housing section 12*a*, although it could be housed elsewhere in bottom hole assembly 6. Controller 190 detects the control signals transmitted from a master controller (not shown) housed in the MWD sub 13 of the bottom hole assembly 6 which, in turn, receives instructions transmitted from the surface via mud pulse telemetry, or any of various other conventional means for transmitting signals to downhole tools.

When controller 190 receives a command to initiate formation testing, the drill string has stopped rotating. As shown in FIG. 9, motor 64 is coupled to pump 66 that draws hydraulic fluid out of hydraulic reservoir 78 through a serviceable filter 79. As will be understood, the pump 66 directs hydraulic fluid into hydraulic circuit 200 that includes formation probe assembly 50, equalizer valve 60, draw down piston 170 and solenoid valves 176, 178, 180.

The operation of formation tester 10 is best understood in reference to FIG. 9 in conjunction with FIGS. 3A, 5 and 6A-C. In response to an electrical control signal, controller 190 energizes solenoid valve 180 and starts motor 64. Pump 66 then begins to pressurize hydraulic circuit 200 and, more particularly, charges probe retract accumulator 182. The act of charging accumulator 182 also ensures that the probe assembly 50 is retracted and that drawdown piston 170 is in its initial shouldered position as shown in FIG. 3A. When the pressure in system 200 reaches a predetermined value, such as 1800 p.s.i. as sensed by pressure transducer 160*b*, controller 190 (which continuously monitors pressure in the system) energizes solenoid valve 176 and de-energizes solenoid valve 180, which causes probe piston 96 and snorkel 98 to begin to extend toward the borehole wall 151. Concurrently, check valve 194 and relief valve 193 seal the probe retract accumulator 182 at a pressure charge of between approximately 500 to 1250 p.s.i.

Figure 6B:
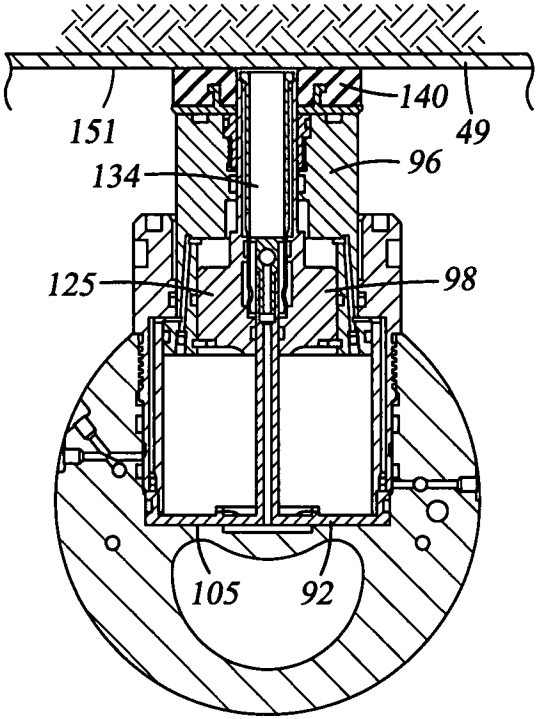
Figure 6A:
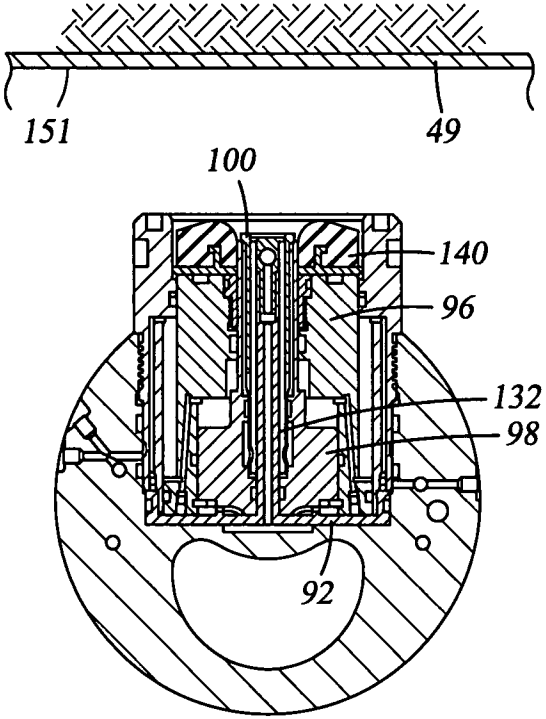

Piston 96 and snorkel 98 extend from the position shown in FIG. 6A to that shown in FIG. 6B where pad 140 engages the mudcake 49 on borehole wall 151. With hydraulic pressure continued to be supplied to the extend side of the piston 96 and snorkel 98, the snorkel then penetrates the mudcake as shown in FIG. 6C. There are two expanded positions of snorkel 98, generally shown in FIGS. 6B and 6C. The piston 96 and snorkel 98 move outwardly together until the pad 140 engages the borehole wall 151. This combined motion continues until the force of the borehole wall against pad 140 reaches a pre-determined magnitude, for example 5,500 lbs., causing pad 140 to be squeezed. At this point, a second stage of expansion takes place with snorkel 98 then moving within the cylinder 120 in piston 96 to penetrate the mudcake 49 on the borehole wall 151 and to receive formation fluids.

As seal pad 140 is pressed against the borehole wall, the pressure in circuit 200 rises and when it reaches a predetermined pressure, valve 192 opens so as to close equalizer valve 60, thereby isolating fluid passageway 93 from the annulus. In this manner, valve 192 ensures that valve 60 closes only after the seal pad 140 has entered contact with mudcake 49 that lines borehole wall 151. Passageway 93, now closed to the annulus 150, is in fluid communication with cylinder 175 at the upper end of cylinder 177 in draw down manifold 89, best shown in FIG. 3A.

With solenoid valve 176 still energized, probe seal accumulator 184 is charged until the system reaches a predetermined pressure, for example 1800 p.s.i., as sensed by pressure transducer 160*b*. When that pressure is reached, controller 190 energizes solenoid valve 178 to begin drawdown. Energizing solenoid valve 178 permits pressurized fluid to enter portion 172*a* of cylinder 172 causing draw down piston 170 to retract. When that occurs, plunger 174 moves within cylinder 177 such that the volume of fluid passageway 93 increases by the volume of the area of the plunger 174 times the length of its stroke along cylinder 177. This movement increases the volume of cylinder 175, thereby increasing the volume of fluid passageway 93. For example, the volume of fluid passageway 93 may be increased by 10 cc as a result of piston 170 being retracted.

As draw down piston 170 is actuated, formation fluid may thus be drawn through central passageway 127 of snorkel 98 and through screen 100. The movement of draw down piston 170 within its cylinder 172 lowers the pressure in closed passageway 93 to a pressure below the formation pressure, such that formation fluid is drawn through screen 100 and snorkel 98 into aperture 101, then through stem passageway 108 to passageway 91 that is in fluid communication with passageway 93 and part of the same closed fluid system. In total, fluid chambers 93 (which include the volume of various interconnected fluid passageways, including passageways in probe assembly 50, passageways 85, 93 [FIG. 3], the passageways interconnecting 93 with draw down piston 170 and pressure transducers 160*a,c*) may have a volume of approximately 40 cc. Drilling mud in annulus 150 is not drawn into snorkel 98 because pad 140 seals against the mudcake. Snorkel 98 serves as a conduit through which the formation fluid may pass and the pressure of the formation fluid may be measured in passageway 93 while pad 140 serves as a seal to prevent annular fluids from entering the snorkel 98 and invalidating the formation pressure measurement.

Referring momentarily to FIGS. 5 and 6C, formation fluid is drawn first into the central bore 132 of screen 100. It then passes through slots 134 in screen slotted segment 133 such that particles in the fluid are filtered from the flow and are not drawn into passageway 93. The formation fluid then passes between the outer surface of screen 100 and the inner surface of snorkel extension 126 where it next passes through apertures 123 in screen 100 and into the central passageway 108 of stem 92 by passing through apertures 101 and central passage bore 103 of scraper 102.

Referring again to FIG. 9, with seal pad 140 sealed against the borehole wall, check valve 195 maintains the desired pressure acting against piston 96 and snorkel 98 to maintain the proper seal of pad 140. Additionally, because probe seal accumulator 184 is fully charged, should tool 10 move during drawdown, additional hydraulic fluid volume may be supplied to piston 96 and snorkel 98 to ensure that pad 140 remains tightly sealed against the borehole wall. In addition, should the borehole wall 151 move in the vicinity of pad 140, the probe seal accumulator 184 will supply additional hydraulic fluid volume to piston 96 and snorkel 98 to ensure that pad 140 remains tightly sealed against the borehole wall 151. Without accumulator 184 in circuit 200, movement of the tool 10 or borehole wall 151, and thus of formation probe assembly 50, could result in a loss of seal at pad 140 and a failure of the formation test.

With the drawdown piston 170 in its fully retracted position and formation fluid drawn into closed system 93, the pressure will stabilize and enable pressure transducers 160*a,c* to sense and measure formation fluid pressure. The measured pressure is transmitted to the controller 190 in the electronic section where the information is stored in memory and, alternatively or additionally, is communicated to the master controller in the MWD tool 13 below formation tester 10 where it may be transmitted to the surface via mud pulse telemetry or by any other conventional telemetry means.

When drawdown is completed, piston 170 actuates a contact switch 320 mounted in endcap 400 and piston 170, as shown in FIG. 3A. The drawdown switch assembly consists of contact 300, wire 308 coupled to contact 300, plunger 302, spring 304, ground spring 306, and retainer ring 310. Piston 170 actuates switch 320 by causing plunger 302 to engage contact 300 that causes wire 308 to couple to system ground via contact 300 to plunger 302 to ground spring 306 to piston 170 to endcap 400 that is in communication with system ground (not shown).

When the contact switch 320 is actuated controller 190 responds by shutting down motor 64 and pump 66 for energy conservation. Check valve 196 traps the hydraulic pressure and maintains piston 170 in its retracted position. In the event of any leakage of hydraulic fluid that might allow piston 170 to begin to move toward its original shouldered position, drawdown accumulator 186 will provide the necessary fluid volume to compensate for any such leakage and thereby maintain sufficient force to retain piston 170 in its retracted position.

During this interval, controller 190 continuously monitors the pressure in fluid passageway 93 via pressure transducers 160*a,c* until the pressure stabilizes, or after a predetermined time interval.

When the measured pressure stabilizes, or after a predetermined time interval, controller 190 de-energizes solenoid valve 176. De-energizing solenoid valve 176 removes pressure from the close side of equalizer valve 60 and from the extend side of probe piston 96. Spring 58 then returns the equalizer valve 60 to its normally open state and probe retract accumulator 182 will cause piston 96 and snorkel 98 to retract, such that seal pad 140 becomes disengaged with the borehole wall. Thereafter, controller 190 again powers motor 64 to drive pump 66 and again energizes solenoid valve 180. This step ensures that piston 96 and snorkel 98 have fully retracted and that the equalizer valve 60 is opened. Given this arrangement, the formation tool 10 has a redundant probe retract mechanism. Active retract force is provided by the pump 66. A passive retract force is supplied by probe retract accumulator 182 that is capable of retracting the probe even in the event that power is lost. Accumulator 182 may be charged at the surface before being employed downhole to provide pressure to retain the piston and snorkel in housing 12*c*.

Referring again briefly to FIGS. 5 and 6, as piston 96 and snorkel 98 are retracted from their position shown in FIG. 6C to that of FIG. 6B and then FIG. 6A, screen 100 is drawn back into snorkel 98. As this occurs, the flange on the outer edge of scraper 102 drags and thereby scrapes the inner surface of screen member 100. In this manner, material screened from the formation fluid upon its entering of screen 100 and snorkel 98 is removed from screen 100 and deposited into the annulus 150. Similarly, scraper 102 scrapes the inner surface of screen member 100 when snorkel 98 and screen 100 are extended toward the borehole wall.

After a predetermined pressure, for example 1800 p.s.i., is sensed by pressure transducer 160*b* and communicated to controller 190 (indicating that the equalizer valve is open and that the piston and snorkel are fully retracted), controller 190 de-energizes solenoid valve 178 to remove pressure from side 172*a* of drawdown piston 170. With solenoid valve 180 remaining energized, positive pressure is applied to side 172*b* of drawdown piston 170 to ensure that piston 170 is returned to its original position (as shown in FIG. 3). Controller 190 monitors the pressure via pressure transducer 160*b* and when a predetermined pressure is reached, controller 190 determines that piston 170 is fully returned and it shuts off motor 64 and pump 66 and de-energizes solenoid valve 180. With all solenoid valves 176, 178, 180 returned to their original position and with motor 64 off, tool 10 is back in its original condition and drilling may again be commenced.

Relief valve 197 protects the hydraulic system 200 from overpressure and pressure transients. Various additional relief valves may be provided. Thermal relief valve 198 protects trapped pressure sections from overpressure. Check valve 199 prevents back flow through the pump 66.

The formation test tool 10 may operate in two general modes: pumps-on operation and pumps-off operation. During a pumps-on operation, mud pumps on the surface pump drilling fluid through the drill string 6 and back up the annulus 150 while testing. Using that column of drilling fluid, the tool 10 may transmit data to the surface using mud pulse telemetry during the formation test. The tool 10 may also receive mud pulse telemetry downlink commands from the surface. During a formation test, the drill pipe and formation test tool are not rotated. However, it may be the case that an immediate movement or rotation of the drill string will be necessary. As a failsafe feature, at any time during the formation test, an abort command may be transmitted from surface to the formation test tool 10. In response to this abort command, the formation test tool will immediately discontinue the formation test and retract the probe piston to its normal, retracted position for drilling. The drill pipe may then be moved or rotated without causing damage to the formation test tool.

During a pumps-off operation, a similar failsafe feature may also be active. The formation test tool 10 and/or MWD tool 13 may be adapted to sense when the mud flow pumps are turned on. Consequently, the act of turning on the pumps and reestablishing flow through the tool may be sensed by pressure transducer 160*d* or by other pressure sensors in bottom hole assembly 6. This signal will be interpreted by a controller in the MWD tool 13 or other control and communicated to controller 190 that is programmed to automatically trigger an abort command in the formation test tool 10. At this point, the formation test tool 10 will immediately discontinue the formation test and retract the probe piston to its normal position for drilling. The drill pipe may then be moved or rotated without causing damage to the formation test tool.

The uplink and downlink commands are not limited to mud pulse telemetry. By way of example and not by way of limitation, other telemetry systems may include manual methods, including pump cycles, flow/pressure bands, pipe rotation, or combinations thereof. Other possibilities include electromagnetic (EM), acoustic, and wireline telemetry methods. An advantage to using alternative telemetry methods lies in the fact that mud pulse telemetry (both uplink and downlink) requires active pumping, but other telemetry systems do not. The failsafe abort command may therefore be sent from the surface to the formation test tool using an alternative telemetry system regardless of whether the mud flow pumps are on or off.

The down hole receiver for downlink commands or data from the surface may reside within the formation test tool or within an MWD tool 13 with which it communicates. Likewise, the down hole transmitter for uplink commands or data from down hole may reside within the formation test tool 10 or within an MWD tool 13 with which it communicates. The receivers and transmitters may each be positioned in MWD tool 13 and the receiver signals may be processed, analyzed, and sent to a master controller in the MWD tool 13 before being relayed to local controller 190 in formation testing tool 10.

Commands or data sent from surface to the formation test tool may be used for more than transmitting a failsafe abort command. The formation test tool may have many preprogrammed operating modes. A command from the surface may be used to select the desired operating mode. For example, one of a plurality of operating modes may be selected by transmitting a header sequence indicating a change in operating mode followed by a number of pulses that correspond to that operating mode. Other means of selecting an operating mode will certainly be known to those skilled in the art.

In addition to the operating modes discussed, other information may be transmitted from the surface to the formation test tool 10. This information may include critical operational data such as depth or surface drilling mud density. The formation test tool may use this information to help refine measurements or calculations made downhole or to select an operating mode. Commands from the surface might also be used to program the formation test tool to perform in a mode that is not preprogrammed.

Measuring Formation Properties

Referring again to FIG. 9, the formation test tool 10 may include four pressure transducers 160: two quartz crystal gauges 160*a*, 160*d*, a strain gauge 160*c*, and a differential strain gage 160*b*. One of the quartz crystal gauges 160*a* is in communication with the annulus mud and also senses formation pressures during the formation test. The other quartz crystal gauge 160*d* is in communication with the flowbore 14 at all times. In addition, both quartz crystal gauges 160*a* and 160*d* may have temperature sensors associated with the crystals. The temperature sensors may be used to compensate the pressure measurement for thermal effects. The temperature sensors may also be used to measure the temperature of the fluids near the pressure transducers. For example, the temperature sensor associated with quartz crystal gauge 160*a* is used to measure the temperature of the fluid near the gage in chamber 93. The third transducer is a strain gauge 160*c* and is in communication with the annulus mud and also senses formation pressures during the formation test. The quartz transducers 160*a*, 160*d* provide accurate, steady-state pressure information, whereas the strain gauge 160*c* provides faster transient response. In performing the sequencing during the formation test, chamber 93 is closed off and both the annulus quartz gauge 160*a* and the strain gauge 160*c* measure pressure within the closed chamber 93. The strain gauge transducer 160*c* essentially is used to supplement the quartz gauge 160*a* measurements. When the formation tester 10 is not in use, the quartz transducers 160*a*, 160*d* may operatively measure pressure while drilling to serve as a pressure while drilling tool.

Figure 10:
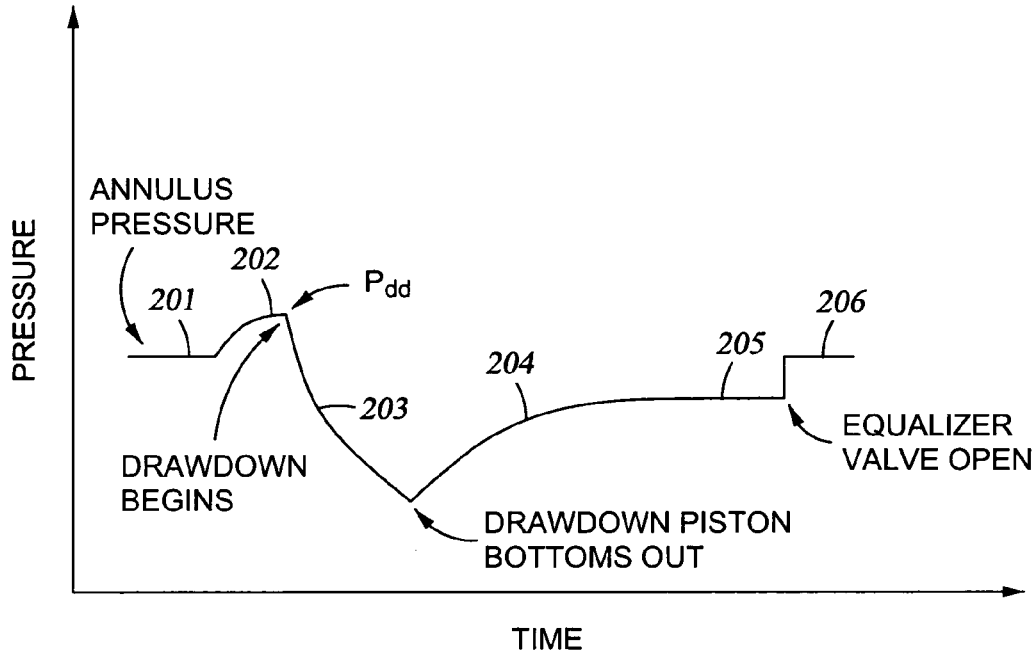
FIG. 10 is a graph of the formation fluid pressure as compared to time measured during operation of the tester apparatus.

Referring now to FIG. 10, a pressure versus time graph illustrates in a general way the pressure sensed by pressure transducers 160*a*, 160*c* during the operation of formation tester 10. As the formation fluid is drawn within the tester, pressure readings are taken continuously by transducers 160*a*, 160*c*. The sensed pressure will initially be equal to the annulus pressure shown at point 201. As pad 140 is extended and equalizer valve 60 is closed, there will be a slight increase in pressure as shown at 202. This occurs when the pad 140 seals against the borehole wall 151 and squeezes the drilling fluid trapped in the now-isolated passageway 93. As drawn down piston 170 is actuated, the volume of the closed chamber 93 increases, causing the pressure to decrease as shown in region 203. This is known as the pretest drawdown. The combination of the flow rate and snorkel inner diameter determines an effective range of operation for tester 10. When the drawn down piston bottoms out within cylinder 172, a differential pressure with the formation fluid exists causing the fluid in the formation to move towards the low pressure area and, therefore, causing the pressure to build over time as shown in region 204. The pressure begins to stabilize, and at point 205, achieves the pressure of the formation fluid in the zone being tested. After a fixed time, such as three minutes after the end of region 203, the equalizer valve 60 is again opened, and the pressure within chamber 93 equalizes back to the annulus pressure as shown at 206.

In an alternative embodiment to the typical formation test sequence, the test sequence is stopped after pad 140 is extended and equalizer valve 60 is closed, and the slight increase in pressure is recorded as shown at 202 in FIG. 10. The normal test sequence is stopped so that a response to the increase in pressure 202 may be observed. Since the test sequence has been stopped before draw down piston 170 is actuated, no fluid flow has been induced by the formation probe assembly; the formation probe assembly is maintaining a substantially non-flow condition. The non-flow pressure response to increase 202 can be recorded and interpreted to determine properties of the mudcake, such as mobility. If the response to increase 202 is a quick equalization of the pressure back to hydrostatic 201, then the mudcake has high permeability, and is most likely not very thick or durable. If the response is a slow decrease in pressure, then the mudcake is likely thicker and more impermeable.

To assist in determining mudcake thickness, in addition to the method described above, the position indicator on the probe assembly, described in the U.S. patent application entitled "Downhole Probe Assembly," having U.S. Express Mail Label Number EV 303483549 US and Ser. No. 11/133,643, may be used to measure how far the probe assembly extends after engagement with the mud filtrate. This measurement gives an indication of how thick the mud filtrate is, and may be used to bolster the data gathered using pressure response, described above. Again, this measurement may be taken under a non-flow condition of the formation probe assembly, as previously described.

When taking pressure measurements, it is also possible to use the different pressure transducers to verify each gauge's reading compared to the others. Additionally, with multiple transducers, hydrostatic pressure in the borehole may be used to reverify gauges in the same location, by confirming that they are taking similar hydrostatic measurements. Because quartz gauges are more accurate, the quartz gauge response may be used to calibrate the strain gauge if the response is not highly transient.

Figure 11:
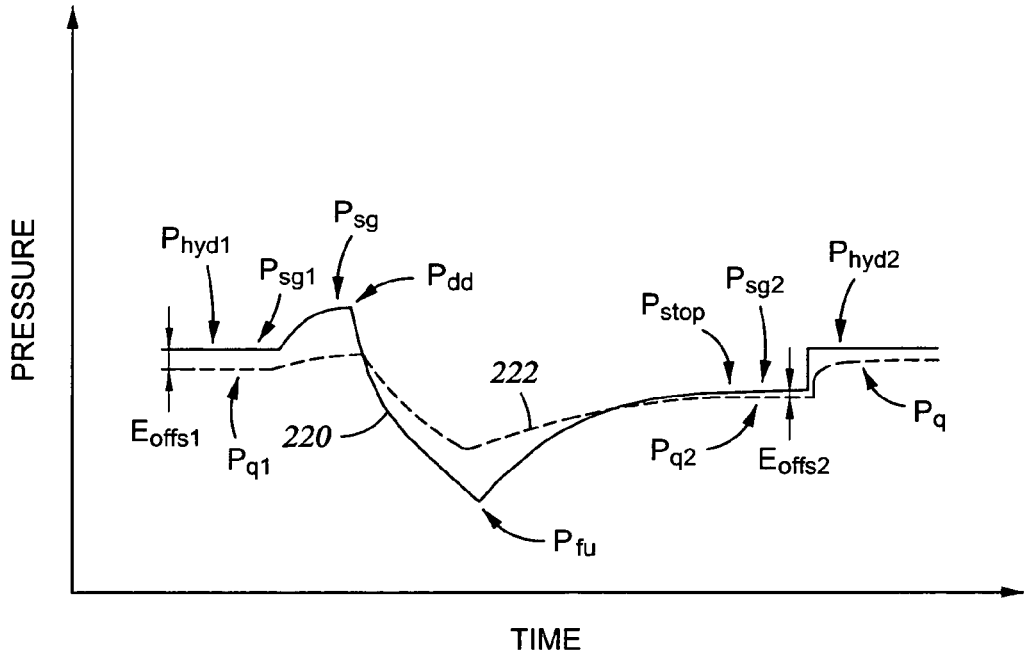
FIG. 11 is another graph of the formation fluid pressure as compared to time measured during operation of the tester apparatus and showing pressures measured by different pressure transducers employed in the formation tester.

FIG. 11 illustrates representative formation test pressure curves. The solid curve 220 represents pressure readings $P_{sg}$ detected and transmitted by the strain gauge 160*c*. Similarly, the pressure $P_q$, indicated by the quartz gauge 160*a*, is shown as a dashed line 222. As noted above, strain gauge transducers generally do not offer the accuracy exhibited by quartz transducers and quartz transducers do not provide the transient response offered by strain gauge transducers. Hence, the instantaneous formation test pressures indicated by the strain gauge 160*c* and quartz 160*a* transducers are likely to be different. For example, at the beginning of a formation test, the pressure readings $P_{hyd1}$ indicated by the quartz transducer Pq and the strain gauge $P_{sg}$ transducer are different and the difference between these values is indicated as $E_{offs1}$ in FIG. 11.

With the assumption that the quartz gauge reading $P_q$ is the more accurate of the two readings, the actual formation test pressures may be calculated by adding or subtracting the appropriate offset error $E_{offs1}$ to the pressures indicated by the strain gauge $P_{sg}$ for the duration of the formation test. In this manner, the accuracy of the quartz transducer and the transient response of the strain gauge may both be used to generate a corrected formation test pressure that, where desired, is used for real-time calculation of formation characteristics or calibration of one or more of the gauges.

As the formation test proceeds, it is possible that the strain gauge readings may become more accurate or for the quartz gauge reading to approach actual pressures in the pressure chamber even though that pressure is changing. In either case, it is probable that the difference between the pressures indicated by the strain gauge transducer and the quartz transducer at a given point in time may change over the duration of the formation test. Hence, it may be desirable to consider a second offset error that is determined at the end of the test where steady state conditions have been resumed. Thus, as pressures $P_{hyd2}$ level off at the end of the formation test, it may be desirable to calculate a second offset error $E_{offs2}$. This second offset error $E_{offs2}$ might then be used to provide an after-the-fact adjustment to the formation test pressures, or calibration of the strain gauge.

The offset values $E_{offs1}$ and $E_{offs2}$ may be used to adjust specific data points in the test. For example, all critical points up to $P_{fu}$ might be adjusted using errors $E_{offs1}$, whereas all remaining points might be adjusted offset using error $E_{offs2}$. Another solution may be to calculate a weighted average between the two offset values and apply this single weighted average offset to all strain gauge pressure readings taken during the formation test. Other methods of applying the offset error values to accurately determine actual formation test pressures may be used accordingly and will be understood by those skilled in the art.

As previously generally described, quartz gauges are used for accuracy because they are steady and stable over time and retain their calibration over a wide variety of conditions. However, they are slow to respond to their environment. There are changes in pressure taking place during the measurement that the quartz gauge cannot detect. On the other hand, strain gauges are susceptible to change and to calibration effects. However, they are quick to respond to changes in their environment. Thus, both gauges may be used, with the quartz gauge used to get an accurate pressure reading while the strain gauge is used to look at the differences in pressure.

Figure 12:
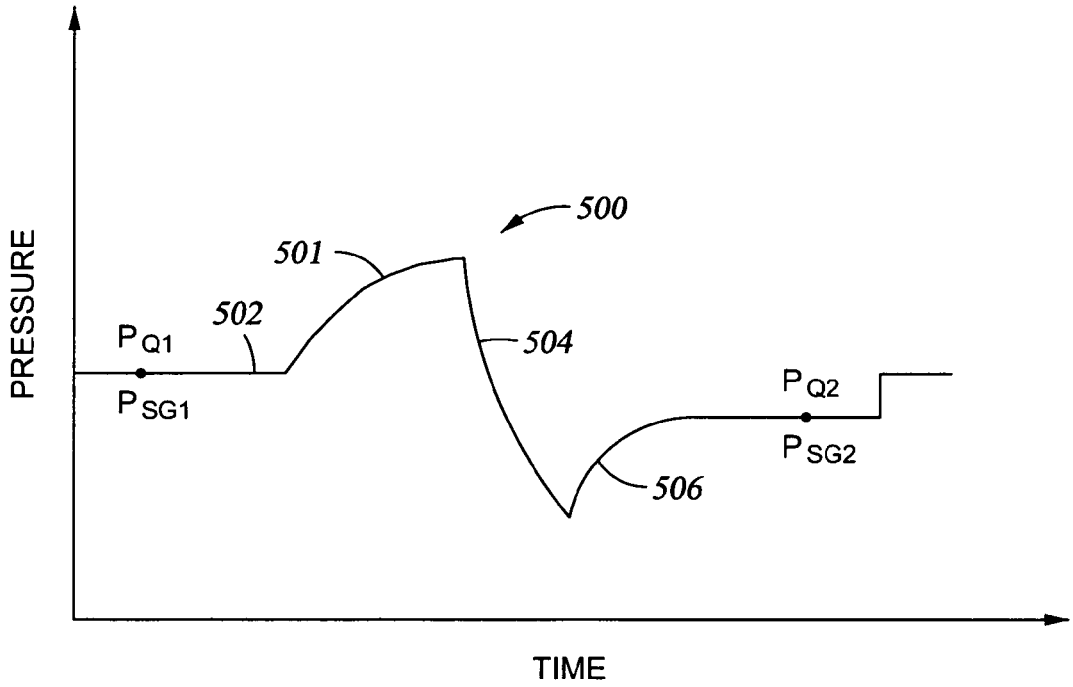
FIG. 12 is another graph of the formation fluid pressure as compared to time measured during operation of the tester apparatus that can be used to calibrate the pressure transducers.

In another embodiment for calibrating the strain gauge using the quartzdyne gauge, a simple linear fit may be used. Referring to FIG. 12, pressure curve 500 is illustrated representing a typical drawdown and buildup curve measured during a pressure formation test. Portion 502 of curve 500 shows a stable pressure, which is typically a measure of the annulus pressure because the formation test has not begun yet. The annulus pressure will usually be higher than the formation pressure because most wells are drilled in overbalanced situations, where the drilling fluid in the annulus is kept at a higher pressure than the formation so as to stabilize the borehole and prevent borehole deterioration and blowout.

The pressures measured by the quartz gauge, $P_{Q1}$, and the corrected strain gauge, $P_{SG1}$, will be the same in curve portion 502, where the pressure is stable and near hydrostatic, and before any dynamic responses are detected by either gauge. Once the formation pressure test has begun, a slight increase in pressure is illustrated at 501 before the drawdown is commenced, illustrated by curve portion 504. After drawdown is completed, the formation pressure is allowed to build back up until it stabilizes, illustrated at curve portion 506. Now, a second set of stabilized pressures may be taken, $P_{Q2}$ and $P_{SG2}$, and they will most likely be different because the dynamic response of the strain gauge is much less accurate than the dynamic response of the quartz gauge.

To recalibrate the strain gauge, two unknown values are identified and a simple linear fit is applied to the known and unknown values. The unknown values may be identified as $P_{off}$, representing the pressure offset between the two sets of stable pressure measurements, and $P_{slope}$, representing the slope of the curve between the two sets of stable pressure measurements. The known values are $P_{Q1}$, $P_{SG1}$, $P_{Q2}$ and $P_{SG2}$. The linear fit equations may be represented as:

$$P_{Q1}=P_{off}+(P_{slope}*P_{SG1}), \text{ and}$$

$$P_{Q2}=P_{off}+(P_{slope}*P_{SG2}); \text{ which may be expressed as:}$$

$$P_{slope}=(P_{Q1}-P_{Q2})/(P_{SG1}-P_{SG2}), \text{ and}$$

$$P_{off}=P_{Q1}-(P_{Q1}-P_{Q2})/(P_{SG1}-P_{SG2})*P_{SG1}; \text{ which may be expressed as:}$$

$$P_{SGcorrected}=P_{off}+(P_{slope}*P_{SG}).$$

With two equations and two unknowns, the equations may be solved as above to arrive at $P_{SGcorrected}$, a corrected value obtained from the strain gauge. Alternatively, the strain gauge may be corrected based on the known values alone, substituting for $P_{off}$ and $P_{slope}$ to acquire the equation: $P_{SGcorrected}=P_{Q1}-(P_{Q1}-P_{Q2})/(P_{SG1}-P_{SG2})*(P_{SG1}-P_{SG\ 2})$.

Further, these gauge corrections may be done "on the fly," or after each test as each sequential test is completed in the wellbore. The corrections may be done on the fly using real time streaming of the data to the surface using telemetry means, or, alternatively, using downhole processors and software placed in the tool.

Using the MWD tool's embedded software (and neural network techniques) and a downhole reference standard, such as the quartz gauge, every depth point in the borehole may be corrected to the reference. In a formation tester, there will typically be various types of pressure gauges for measuring pressure in the flow lines that carry formation fluids. For example, the formation fluid flow lines, such as lines 91, 93 may be in fluid communication with quartz gauges and strain gauges, such as transducers 160*a*, 160*c* of FIG. 9. After a drawdown, where formation fluids are drawn into the formation tester, drawing in of fluids is stopped and the fluids are allowed to build back up to the pressure of the surrounding formation. After several of these drawdowns and buildups, the strain gauges may exhibit large errors in their readings. Thus, as mentioned before, these strain gauge pressure transducers need to be calibrated. In one embodiment, the pressure readings at every point in the well where pressure was measured may be used as a reference point for continual calibration of the strain gauges, thereby eliminating the need to calibrate and recalibrate the strain gauges.

Every location in the well has a discrete pressure and associated temperature as well stabilization occurs. Each time a pressure test is run, the pressure taken by the quartz gauge may be used as a continual calibration point for the strain gauges. If the data is continuously collected, a three-dimensional, contour-type plot of pressure vs. temperature may be created. The three dimensions that may be used are measured pressure, reference pressure, as described above, and temperature. Then, neural network techniques found in the tool's embedded software may be applied to the collected data such that the strain gauge transducers do not require recalibration.

Pressure transducers typically have a pressure data input range to which their accuracy is defined, such as zero to 10,000 p.s.i. or zero to 20,000 p.s.i. Accuracy is commonly measured as a percentage of full scale, thus the accuracy of a 10,000 p.s.i. gauge will be greater because the percentage number of that gauge will be less than the same percentage number of 20,000. To improve accuracy of the formation testing tool, several gauges may be used to cover the possible ranges of pressures to be tested, instead of using one gauge that covers the whole range. Therefore, to make the tool more accurate, multiple pressure gauges are used.

Alternatively, the range of a gauge may be calibrated for a smaller range to make the gauge more accurate. The manufacturer of the pressure gauge may set the electronics to detect a broad range of pressures. The electronics, which are very similar between gauges, may be adjusted to scale the transducer over a smaller range, thereby improving accuracy. Similarly, the same transducer may be used for different pressure ranges by using two or more calibration tables. The pressure data output effect of the transducer for the full pressure input range may be determined for one pressure transducer, and then two or more calibration tables may be established to interpret the output information given by the transducers for different pressure input ranges. Therefore, accuracy may be improved without the use of multiple transducers.

Accurate determination of formation pressure is vital to proper use of the measured formation pressures. However, changing densities of fluids in the formation testing tool's flow lines can be problematic. The measured pressure can be corrected for the density of the fluid in the vertical column of the flow line. The pressure transducers may be measuring accurate pressures of the formation fluids the transducers communicate with, but these transducers are removed from the location of the probe that gathers the formation fluids. For example, transducers 160*a*, 160*c*, 160*d* are located below the probe assembly, as illustrated in FIG. 2D-E. Thus, the pressure at the probe may be different from the pressure measured at the transducers due to this location offset.

Preferably, the vertical offset between the reference point of the transducer and the fluid inlet point at the probe is a known distance. Additionally, if the formation testing tool is located in a deviated or inclined well, the orientation of the tool may be known from a navigational package. Thus, vertical known distance between the transducer and the probe inlet may be calculated for any inclination of the tool in the well. Lastly, if the fluid present in the flow line connecting the transducer and the probe inlet is known, then the pressure gradient of that fluid may be used to calculate the pressure at the probe inlet with respect to the pressure at the transducer.

For example, water has a pressure gradient of 0.433 p.s.i. per foot. If it was known that water was present in the flow line and that there was a foot difference between the pressure transducer and the probe inlet, a 0.433 p.s.i. correction may be made in the reading of the pressure transducer.

Thus, it is preferred that the pressure transducers be disposed as close to the probe assembly as possible.

In another embodiment of formation testing, while the formation probe assembly is engaged with the borehole, instead of pulling fluids into the probe assembly, or after pulling fluids into the probe assembly, fluids can be pushed out of the assembly into the formation. Thus, fluid communication may be established with the formation in the direction that is opposite to that of draw down, with such communication tending to pressure up the formation. This may be accomplished by adjustments to the sequence of events described previously. Now, the response to this pressure up can be recorded, and the pressure over time can observed for a portion of the formation. How the formation responds can be interpreted to obtain many of the formation properties previously described. Specifically, the pressure transient response to the change in formation pressure may be used to determine permeability of the mud cake, estimating the damage to the near wellbore formation and calculating mobility of the formation. For further detail on the process just described, reference may be made to the Society of Petroleum Engineers paper number 36524 entitled "Supercharge Pressure Compensation Using a New Wireline Method and Newly Developed Early Time Spherical Flow Model" and U.S. Pat. No. 5,644,075 entitled "Wireline Formation Tester Supercharge Correction Method," each hereby incorporated herein by reference for all purposes.

Furthermore, the formation may be pressured up as just described, except to the point where the formation material breaks or fractures. This is called an injectivity test, and may be done with fluid from the same area (at the present measurement location), or fluid, such as water, which may be obtained from another area of the formation. The fluids obtained from another area may be stored in either a pressure vessel or in the drawdown piston assembly, and then injected into another area that contains a different fluid. Fluids may also be carried from the surface and selectively injected into the formation.

If injection rates are high enough to materially break or induce fracture in the formation, a change in pressure can be observed and interpreted, as has been previously described, to obtain formation properties, such as fracture pressure, which may be used to efficiently design future completion and stimulation programs. It should be noted that the injectivity may be performed to test the mud cake's ability to prevent fluid ingress to the formation. Alternatively, the test may be performed after a draw down and the mud cake is no longer present.

Formation testers may also be used to gather additional information aside from properties of the producible hydrocarbon fluids. For example, the formation tester tool instruments may be used to determine the resistivity of the water, which can be used in the calculation of the formation's water saturation. Knowing the water saturation helps in predicting the producibility of the formation. Sensor packages, such as induction packages or button electrode packages, may be added adjacent the probe assembly that are tailored to measuring the resistivity of the bound water in the formation. These sensors, preferably, would be disposed on the extending portions of the probe assembly, such as the snorkel 98 that may penetrate the mudcake and formation, as illustrated in FIG. 6C. In addition, sensors may be disposed in the flow lines, such as flow lines 91, 93, to measure water properties in the fluids that are drawn into the formation tester assembly.

The advantage of the probe style formation test tool described herein is the flexibility to place the probe in a specific position upon the borehole to best obtain a formation pressure, or, alternatively, to not place the probe in an undesirable location. A tool such as an acoustic imaging device can provide a real time image of the borehole so the operator can determine where to take a pressure test. Additionally, the image from a porosity-type tool may provide information on porosity quality at an orientation within a portion of the well at constant depth, or at a direction along the wellbore (constant azimuth). It may also provide a real-time image of fractures intersecting the wellbore, providing the opportunity to avoid these fractures to obtain a good test for matrix pressures, or to test at these fractures to determine fracture properties. The image from these tools may be sensitive enough to determine that the probe from the pressure device actually tested at the pre-determined position and verify that the test was taken at the chosen position. These tools may also be used to examine the condition of the wellbore. This may be significant in high angle or horizontal wellbores where debris such as unremoved cuttings may still be in place and could interfere with obtaining an accurate formation pressure measurement.

It is common for the borehole to exhibit abnormalities due to erosion from the drill string or circulated drilling fluids. Abnormalities also exist due to fault lines and different types of formations abutting each other. Thus, often it is necessary to have a pre-existing image of the formation so that pressure measurements may be taken at pinpoint locations rather than at random locations in the formation. Acoustic, sonic, density, resistivity, gamma ray and other imaging techniques may be used to image the formation in real time. Then, the formation testing tool may be azimuthally oriented to locations of greatest or least porosity, permeability, density or other formation property, depending on what is to be gained from the pressure or other formation testing tool measurement. In cases where imaging tools indicate a sealing or "tight" zone, pressure measurements may be used to verify whether there is fluid communication or not. Alternatively, the imaging tools may be used to find zones that should not be pressure tested, such as highly dense or impermeable zones.

Afterwards, the previously mentioned imaging techniques may be used to verify where the pressure or other measurement was taken. The seal pad may leave an imprint on the borehole wall, thus an electrical imaging tool or acoustic scanning tool may be used to image after the test to verify the pad location on the borehole wall.

Pressure and other formation testing tool measurements may be taken with the mud pumps on or off. Pressure in the annulus is higher with pumps on than with pumps off, and the pressure drops in the direction of flow. With higher pressures from circulating, there is a higher rate of influx of drilling fluids and filtrate going into the formation, thus forming the mudcake more rapidly. The equivalent circulating density (ECD) is a measure of the drilling fluid density taking into account suspended drilling cuttings, fluid compressibility and the frictional pressure losses related to fluid flow. ECD will decrease with time if circulation continues but drilling stops because, as the drilling mud circulates, more of the drilling cuttings are filtered out while new cuttings are not being added. If pressure measurements are being taken by the formation tester, a difference may be noticed in the formation pressure because of the change in ECD from pumps-on to pumps-off.

For example, the formation probe assembly may be extended and a drawdown test performed wherein the pressure decreases as the fluids are drawn into the formation tester. Then, after the drawdown chamber is full, the pressure may build back up to equilibrate with the pressure in the undisturbed formation. Now, if the pumps are turned on, the ECD in the annulus increases, increasing the pressure sensed by the formation tester. If the pumps are turned off, the pressure will return to the original pressure before pumps were turned on. This pressure difference is due to the difference in the ECD and the hydrostatic pressure, and may be used to indicate how much drilling fluid is penetrating the formation, or how much communication there is between the drilling fluids and the formation. This difference may be equated to mobility or pressure transients, thereby obtaining more accurate measurements. These effects are associated with supercharge pressures and effects, which are more thoroughly described in various of the previously incorporated references.

With the pumps on, pressure pulses are sent downhole by the mud pumps, communication pulsers or other devices, and the pulses may be seen to exhibit sinusoidal behavior. During a pressure test, with the probe assembly extended, the probe may detect these pressure pulses through the formation because the inside of the probe assembly is relatively isolated from the wellbore fluids. The pressure pulses as detected in the wellbore may be compared with the pressure pulses as detected by the formation tester.

Figure 13:
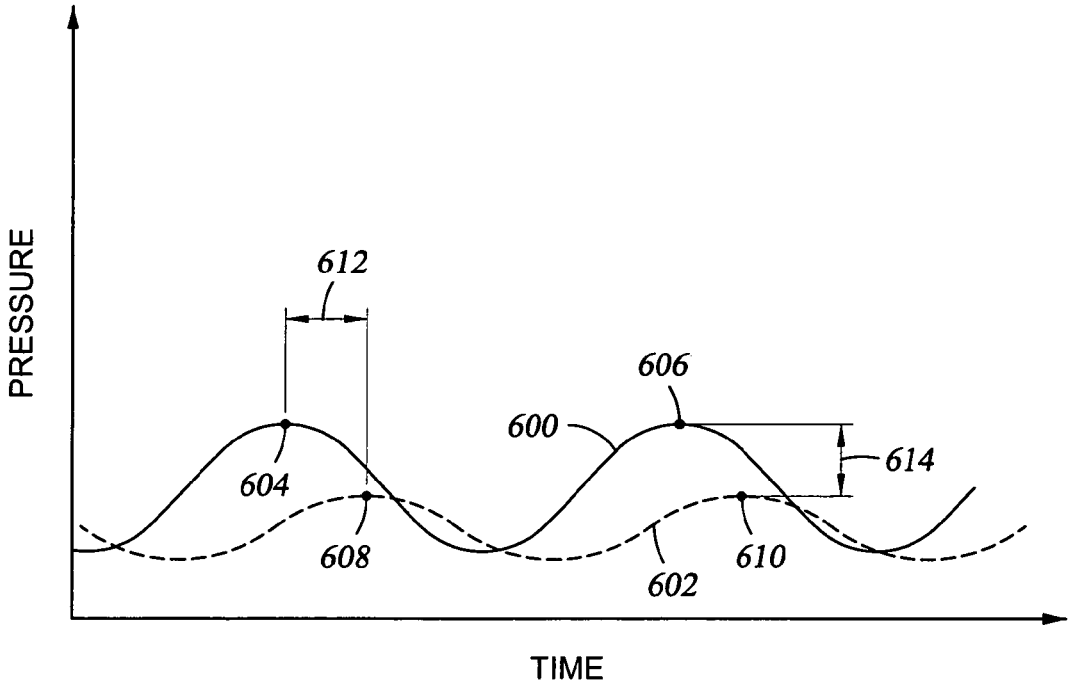
FIG. 13 is a graph of the annulus and formation fluid pressures in response to pressure pulses.

Referring now to FIG. 13, a pressure pulse curve 600 represents pressures created by the mud pumps or pulsers and detected by a pressure sensor in communication with the annulus such as a PWD sensor in the MWD tool 13, or other LWD tool. Pressure curve 602 represents pressures detected by the formation probe assembly, which are the pressure pulses that have traveled from the annulus, through the formation, and into the isolated probe assembly. Pressure curves 600 and 602 have peaks 604, 606 and 608, 610, respectively. These peaks may be used to determine peak shifts or phase delay 612 and amplitude difference 614. With the phase delay 612 and amplitude difference 614, mudcake properties, such as permeability, porosity and thickness may be determined. Further, similar formation properties may be determined.

In an alternative embodiment to the embodiment just described, the formation testing tool includes more than one formation probe assembly. Instead of creating pressure pulses at the surface of the wellbore, the pulses may be created by one probe assembly while the other probe assembly takes measurements. While at least two formation probe assemblies are extended and engaged with the borehole wall, one probe assembly may pulse fluid into the assembly and back out into the formation by reciprocating the draw down pistons. Meanwhile, the other probe assembly takes measurements as described above.

Formation tests may be taken with the formation tester tool very soon after the drill bit has penetrated the formation. For example, the formation tests may be taken immediately after the formation has been drilled through, such as within ten minutes of penetration. Taking tests at this time means there is less mud invasion and less mudcake to contend with, resulting in better pressure and/or permeability tests, better formation fluid samples (less contamination) and less rig time required to obtain these data. Taking tests immediately after drilling will also allow the drilling operator look for casing points immediately. These tests may also indicate whether the zone is depleted, or whether hole collapse is imminent. Corrective actions may then be taken, such sa casing the hole, changing mud properties, continuing drilling, or others.

Additionally, the formation may be tested on the way into a drilled hole and on the way out to observe changes in the mudcake and formation over time. The two sets of measurements may be compared to identify changes that are occurring to the borehole and surrounding formation. The differences over time may indicate supercharging effects, more fully developed in the various references previously mentioned, and may be used to correct a model of the formation to account for the supercharge pressure.

Predicting pore pressure is typically accomplished by measuring the magnitude of formation compaction. Formation compaction typically occurs in shales, thus shale formations must be drilled and logged to obtain the necessary data to create pore prediction models. The formation testing tool described herein may measure pore pressure directly. This measurement is more accurate and may be used to calibrate pore pressure predictor models.

Using Formation Property Data

After measuring formation pressure, permeability and other formation properties, this information may be sent to the surface using mud pulse telemetry, or any of various other conventional means for transmitting signals from downhole tools. At the surface, the drilling operator may use this information to optimize bit cutting properties, or drilling or downhole operation parameters.

Knowing mudcake properties allows adjustments to certain drilling parameters if the mudcake differs from a known, predetermined, or desirable value; adjustments to the mud system itself may also be made, to enhance the mud properties and reduce mud cake thickness or filtrate invasion rate. For example, if the mudcake is found to be contaminated or impermeable, the drilling mud properties can be adjusted to reduce the pressure on the mudcake or reduce the amount of contaminants ingressing into the mudcake, or chemicals may be added to the mud system to correct mud cake thickness.

Furthermore, pressure measurements taken downhole may indicate the need to make downhole pressure adjustments if, again, the downhole measurements differ from a desirable known or predetermined value. However, instead of adjusting mud properties, other mechanical means may be use to control the downhole pressure. For example, with a choke control or a rotating blowout preventer (BOP), the choke or rotating BOP restriction may be manipulated to mechanically increase or decrease the resistance to flow at the surface, thereby adjusting the downhole pressure.

An exemplary drilling parameter that may be adjusted is the rate of drill bit penetration. Using the formation tester in the ways described above, certain rock properties, also described above, can be measured. These properties may be directed to the surface in real time so as to optimize the rate of penetration while drilling. With a certain shape of the probe and knowing the shape of the frontal contact area of the borehole wall, certain formation properties may be measured. If a formation probe assembly such as that illustrated in FIGS. 5 and 6A-C, or in the U.S. patent application entitled "Downhole Probe Assembly," previously mentioned and incorporated by reference, is used to engage the formation, force vs. displacement of the probe assembly may then be determined using an extensiometer or potentiometer. The force vs. displacement information may be used to calculate compressive strength, compressive modulus and other properties of the formation materials themselves. These formation material properties are useful in determining and optimizing the rate of drill bit penetration.

Measurements taken by the formation testing tool may be used for optimizing additional drilling applications. For example, formation pressure may be used to determine casing requirements. The formation pressures taken downhole may be used to determine the optimal size and strength of the casing required. If the formation is found to have a high formation pressure, then the hole may be cased with a relatively strong casing material to ensure that the integrity of the borehole is maintained in the high pressure formation. If the formation is found to have a low pressure, the casing size may be reduced and different materials may be used to save costs. Rock strength measurements taken with the tool may also assist with casing requirements. Solid rock formations require less casing material because they are stable, while formations composed of sediments require thicker casing.

In inclined or horizontal wells, and particularly when the drilling fluid has stopped circulating, heavier density particles in the drilling fluid settle toward the lower side of the borehole. This condition is undesirable because the effective density of the fluid is lowered. When the surrounding formation is at a higher pressure than the drilling fluid, hole blowout becomes more likely. To detect this condition, the formation testing tool may be oriented to the low side of the borehole, where measurements may now be taken. In one embodiment, the probe assembly may be extended and pressures taken. Preferably, the pressure transducers that are in communication with the annulus, such as transducer 160*c* or the PWD sensor in the MWD tool, can be used to take the pressure of the annulus fluid without extending the probe. If the fluid on the low side of the borehole is found to have a higher density or weight than the equivalent drilling fluid density or weight, then the drilling fluid properties may be adjusted to correct this condition. Alternatively, or in addition, the measurements may be taken at other locations in the borehole, such as at the upper side.

Anisotropic formations exhibit properties, any property, with different values when measured in different directions. For example, resistivity may be different in the horizontal direction than in the vertical direction, which may be due to the presence of multiple formation beds or layering within certain types of rocks.

For example, formation anisotropy may be determined by taking formation measurements, such as pressure and temperature, re-orienting the tool rotationally and taking additional measurements at additional angles around the borehole. Alternatively, if multiple probe assemblies or other measuring devices are disposed about the tool, these measurements taken about the tool may be taken simultaneously. In addition to taking direct formation measurements, the tool may take other measurements, such as sonic and electromagnetic measurements. After all such measurements have been taken, the formation anisotropy for each type of measurement may be calculated. A formation anisotropy value may be tied to or compared with acoustic, resistivity and other measurements taken by other tools. This would allow, for example, resistivity to be correlated with permeability changes using known formation models (more fully described below).

Typically, formation pressure measurements are estimated and/or predicted by interpreting certain formation measurements other than the direct measurement of formation pressure. For example, pressure while drilling (PWD) and logging while drilling (LWD) measurements are gathered and analyzed to predict what the actual formation pressure is. Analysis of data such as rock properties and stress orientation, and of models such as fracture-gradient models and trend-based models, can be used to predict actual formation pressure. Furthermore, direct formation measurements may be used too supplement, correct or adjust these data and models to more accurately predict formation pressures. The advantage with the formation testing tools described and referenced herein is that the pressure and other formation data may be sent uphole real time, thereby allowing the models to be updated real time.

Additionally, each measured formation property, including those previously listed and defined, may themselves be used to map or image the formation. Ultimately, a formation model is developed so it is known what the formation looks like on a computer screen at the surface of the borehole. An example of such a formation model is the Landmark earth model. Each additional measured property of the formation may be used to make complementary images, with each new property and image adding to the accuracy of the formation model or image. Thus, the properties gathered by the formation tester tools referenced herein, particularly pressure data, may be used to create better models or enhance existing ones, to better understand the formations that are being penetrated. As described before, these models and data may be updated "on the fly" to calibrate various models for better formation pressure predictions.

Similarly, formation test data, such as pressure, temperature and other previously described data, gathered using a formation testing tool 10 may be used to improve or correct other measurements, and vice-versa. Other measurements that may benefit from real time pressure data and pressure gradient information include: pressure while drilling (PWD), sonic or acoustic tool measurements, nuclear magnetic resonance imaging, resistivity, density, porosity, etc. These measurements or interpretive tools, such as pore-pressure prediction tools or models, may be updated based on physical measurements, and are at least somewhat dependent on pressure or other formation properties. Drilling mud properties may also be adjusted in a similar fashion, based on the formation measurements taken real time. Further, the formation data may be used to assist other services, including drilling fluid services and completion services, and operation of other tools.

While drilling, LWD tools may be measuring the resistivity of the formation fluids and creating resistivity logs. From the resistivity log and other data, water saturation of the formation may be calculated. Changes in water saturation with depth may be observed and may be consolidated into a gradient. The water saturation level is related to how far above the 100% free water level the test depth is. The water saturation levels and gradient may be used to create a capillary pressure curve. The pressure data from the formation testing tool may be matched up with the capillary pressure curve, which may then be projected downhole to estimate the free water level. The free water level may be used to determine the amount of hydrocarbons, especially gas, that are available for production. At the 100% free water level, production is not viable. Thus, the free water level may be determined without having to test down to the actual free water level.

Pressure measurements may also be used to steer the bottom hole assembly (BHA). If formation pressure measurements indicate that the current zone is not producible or otherwise unattractive for drilling, then the BHA, including the drill bit, may be steered in another direction. An example of a steerable BHA assembly is Halliburton's GeoPilot system. Such directional drilling is intended to steer the BHA into the highest pressure portions of the reservoir, maintain the BHA in the same pressure zone, or avoid a decreased pressure zone. Again, petrophysical data, such as those formation properties previously mentioned, may also be used to more accurately steer the BHA.

The bubble point, as previously defined, can be a beneficial real time measurement. Measuring changes in the bubble point of formation fluids with depth of the formation tester tool in the wellbore allows a bubble point gradient to be determined. Plotting the bubble point gradient generally allows transitions back and forth between gas, water and oil and to be observed, or identification of a zone that is not connected to another zone based on downhole pressure measurements. The bubble point gradient may be used to steer the BHA. Steering downward toward denser fluids is desirable, as the lighter fluids, i.e., the ones having higher bubble points due to retaining more dissolved gases, tend to move upward. Therefore, as fluids with lower bubble points are encountered, the BHA is steered toward these fluids.

The bubble point gradient, as well as other gradients, may be computed on the fly as bubble points and pressure measurements are taken at different depths during the same trip into the borehole. The data is sent to the surface real time for the gradients to be calculated and used.

As described above, pressure while drilling, taken in the annulus, and actual formation pressure are two distinct measurements. With the ability to obtain actual formation pressure, these two measurements may be combined and interpreted for flags, or warnings, and the flags may then be sent to the surface. Prior to the advent of FTWD, these measurements had to combined and interpreted at the surface because actual formation pressure could only be obtained after drilling had stopped. Therefore, the warning could only be determined after the fact. The types of flags that may be sent to the surface include the annulus pressure being below the formation pressure and the annulus pressure being above the fracture gradient.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. A method of using a formation property, the method comprising:

disposing a bottom hole assembly adjacent the distal end of a drill string, the bottom hole assembly having:

a drill bit; and a formation tester tool having an extendable probe and a first sensor, the extendable probe including a first member extendable beyond the formation tester tool and a snorkel extendable beyond the first member;

drilling a borehole to a first depth;

extending the probe first member to engage a formation;

extending the probe snorkel to couple to the formation;

measuring a formation property; and adjusting a downhole parameter if the formation property differs from a known value.

2. The method of claim 1 wherein the formation property comprises at least one of a mudcake property, a formation material property, and a formation fluid pressure.

3. The method of claim 2 further comprising:

recording a plurality of probe engagement force values and probe displacement values; and calculating at least one of a compressive strength and a compressive modulus.

4. The method of claim 1 wherein the downhole parameter comprises at least one of a rate at which a drilling fluid is pumped, a property of the drilling fluid, a borehole casing requirement, a drill bit penetration rate, and a downhole pressure.

5. The method of claim 1 wherein the formation property comprises a formation fluid pressure, and adjusting a downhole parameter comprises mechanically manipulating a downhole pressure at a surface of the borehole if the formation fluid pressure differs from a known value.

6. The method of claim 1 wherein the drilling a borehole comprises drilling an inclined borehole to a first depth, the borehole having a high side and a low side, the method further comprising:

orienting the extendable probe toward a predetermined location;

communicating a fluid from adjacent the predetermined location to the first sensor;

measuring a pressure of the fluid;

calculating a density value of the fluid; and wherein adjusting a downhole parameter comprises adjusting a drilling parameter if the density value differs from a known value.

7. The method of claim 6 wherein the fluid is selected from the group consisting of annulus fluid and formation fluid.

8. The method of claim 6 wherein the drilling parameter comprises a drilling fluid property.

9. The method of claim 6 wherein the known value comprises at least one of an equivalent drilling fluid density, an equivalent circulating density, and an equivalent formation fluid density.

10. The method of claim 9 wherein the predetermined location is the low side of the borehole, and adjusting a drilling parameter further comprises adjusting at least one of the densities if the calculated density value is greater than the at least one density.

11. The method of claim 9 wherein the predetermined location is the high side of the borehole, and adjusting a drilling parameter further comprises adjusting at least one of the densities if the calculated density value is less than the at least one density.

12. The method of claim 1 wherein:

the formation property comprises a bubble point value of a formation fluid; and the downhole parameter comprises a drilling direction of the bottom hole assembly.

13. The method of claim 12 further comprising:

measuring a second bubble point value at a second depth; and calculating a bubble point gradient.

14. A method of using a formation property, the method comprising:

disposing a bottom hole assembly adjacent the distal end of a drill string, the bottom hole assembly having:

a drill bit; and a formation tester tool having an extendable probe and a first sensor, the extendable probe including a first member extendable beyond the formation tester tool and a snorkel extendable beyond the first member;

drilling a borehole to a first depth;

extending the probe first member to engage a formation;

extending the probe snorkel to couple to the formation;

measuring a formation property;

communicating the formation property to a known formation description data set during drilling of the borehole; and adjusting the known formation description data set in response to the formation property during drilling of the borehole.

15. The method of claim 14 wherein the formation property comprises a formation fluid pressure.

16. The method of claim 14 wherein the known data set comprises at least one of a formation model, pressure measurements while drilling, sonic measurements, acoustic measurements, nuclear magnetic resonance imaging measurements, resistivity measurements, density measurements and porosity measurements.

17. The method of claim 14 further comprising:

measuring a plurality of formation properties at a plurality of depths in the borehole;

continually communicating each of the plurality of formation properties after each property is measured; and continually adjusting the known data set after each property is communicated.

18. The method of claim 14 wherein the formation property comprises a fluid pressure and the known data set comprises a fluid resistivity data set, and further comprising predicting a water saturation level at a second depth below the first depth.

19. A method of using a formation property, the method comprising:

disposing a drill collar in a borehole at a first depth, the drill collar comprising a formation tester tool, a formation probe assembly, and a first sensor;

measuring a first formation property at a first location at the first depth with said drill collar;

measuring a second formation property at a second location at the first depth with said drill collar; and manipulating the first and second formation properties to obtain downhole information.

20. The method of claim 19 wherein manipulating the first and second formation properties comprises calculating a formation anisotropy.

21. The method of claim 20 further comprising:

measuring a third formation property; and correlating the third formation property and the formation anisotropy by inputting the values into a formation model.

22. The method of claim 19 wherein the first formation property is an annulus fluid pressure and the second formation property is a formation fluid pressure, and manipulating the fluid pressures comprises calculating a difference value between the pressures, the method further comprising:

sending a warning if the difference value is different from a known value.

* * * * *